US005915371A

United States Patent [19]

Hering

[11] Patent Number: 5,915,371

[45] Date of Patent: Jun. 29, 1999

[54] FORAGED FUEL STOVE

[76] Inventor: Kent M. Hering, 802 Circle Dr., Buffalo, Minn. 55313

[21] Appl. No.: 09/094,222

[22] Filed: Jun. 9, 1998

Related U.S. Application Data

[60] Provisional application No. 60/050,023, Jun. 16, 1997.

[51] Int. Cl.[6] ..... F24C 1/16

[52] U.S. Cl. ..... 126/9 R; 126/30

[58] Field of Search ..... 126/30, 9 R, 9 B, 126/25 R, 29; 248/37.6, 112, 302

[56] References Cited

U.S. PATENT DOCUMENTS

| | | | |
|---|---|---|---|
| 146,226 | 1/1874 | Brewer | 126/30 |
| 885,356 | 4/1908 | Miller . | |
| 915,239 | 3/1909 | Stapp . | |
| 1,194,131 | 8/1916 | Brown . | |
| 1,221,514 | 4/1917 | Crain . | |
| 2,488,014 | 11/1949 | Higman | 126/59 |
| 2,573,211 | 10/1951 | Manzler | 126/25 |
| 2,792,773 | 5/1957 | Barker | 99/421 |
| 3,109,420 | 11/1963 | Ott et al. | 126/9 R |
| 3,146,773 | 9/1964 | Melzer | 126/9 R |
| 3,331,365 | 7/1967 | Sussan | 126/25 R |
| 3,683,886 | 8/1972 | Metzner et al. | 126/9 R |
| 4,324,174 | 4/1982 | Conradt | 99/421 |
| 4,971,045 | 11/1990 | Probat | 126/65 |
| 4,977,824 | 12/1990 | Shinier | 99/449 |
| 5,842,463 | 12/1998 | Hall | 126/9 R |

FOREIGN PATENT DOCUMENTS

| | | | |
|---|---|---|---|
| 6676/27 | 3/1927 | Australia | 126/30 |

OTHER PUBLICATIONS

The Complete Wilderness Training Book by Hugh McManners, p. 115: (Illustration and description of the Yukon Stove).

The Campmor Spring 1996 Catalog, pp. 75, 77: Illustrations and descriptions of MSR Model XGK Shaker Stove; Optimus SVEA 123R stove; Sierra Zip Wood–burning Camping Stove; KwikCook Metal Folding Stove.

*Primary Examiner*—Ira S. Lazarus
*Assistant Examiner*—Sara Raab
*Attorney, Agent, or Firm*—Michael D. Fitzpatrick

[57] ABSTRACT

A four season, lightweight, highly efficient stove, versatile enough to meet the needs of a solo backpacker and weekend camping groups, that will boil one quart of water at an outdoor temperature of 0° F. in less than five minutes using foraged fuel. This stove consists of two semi-cylindrical pieces of metal detachably joined together at the side edges, with all the parts continuously linked together to form a one-piece stove. It provides a light weight, easy to set up, stove which occupies minimal space, being easily wrapped around a sleeping pad. The stove uses twigs and other materials normally found around a campsite for fuel. Hence there is no need for one to bring one's own fuel when going camping.

20 Claims, 17 Drawing Sheets

FORAGED FUEL STOVE

1.0 RELATED APPLICATIONS

This application claims the benefit of U.S. Provisional Application No. 60/050,023 filed on Jun. 16, 1997.

2.0 BACKGROUND

The image of cooking over a wood fire beckons many campers. Cooking over open campfires is not universally allowed, is inefficient, and is difficult to control. To solve these problems, people have turned to cook stoves that are fueled by refined petroleum products. These stoves separate us from the sights, sounds, and smells of a campfire. They require the user to buy and carry fuel. Additionally, they include environmental costs associated with obtaining and refining the petroleum. There is an unmet need for a superior alternative to petroleum fueled camp stoves that is efficient, uses materials for fuel that are normally found near a campsite, provides adjustable heat output, packs into a small space, is lightweight, simple to assemble and disassemble, and works well in cold weather.

3.0 SUMMARY

3.1 Opening

It is, therefore, the main object of the invention to provide a foraged fuel stove which is easy to pack, assemble, and disassemble, occupies very little packing space, is light weight, uses twigs, small sticks, and other materials normally found near a camping site as fuel, and will boil one quart of water at an outdoor temperature of 0° F. in less than 5 minutes. (Foraged fuel refers to fuel which has been gathered in the vicinity of a camp site rather than having been purchased and then carried to the camp site.) Thus by means of my invention, there has been provided a foraged fuel stove which satisfies all these objectives. This stove is the result of six major revisions in design that evolved from field testing over a two and one-half year period. The idea for a foraged fuel stove came from my realization of the environmental costs of using stoves that are fueled by refined petroleum products—costs such as obtaining and refining petroleum, and packaging and transporting the fuel.

3.2 Contents

Basically the present invention is a foraged fuel stove consisting of two semi-cylindrical sheets of metal, and wires which keep the parts of the stove together, and assist in setting up and using the stove.

My foraged fuel stove is made from two 10"×13" semi-cylindrical pieces of sheet metal with the side edges folded to make the semi-cylindrical pieces of sheet metal interlockable with each other. It will be noted that one side edge terminates in a V-shaped bend and the other side edge has a matching clasp-like structure to securely hold the V-shaped bend. If the two sections of semi-cylindrical metal sheets are positioned so that the concavity of the first section faces the concavity of the second section, the two sections can then be joined by inserting the side edge of one section which terminates in the V-shaped bend into the clasp like structure at the side edge of the other section. Then, likewise the V-shaped bend at one side edge of the second section is inserted into the clasp like structure at the side edge of the first section. In this way, an 8" diameter cylinder is formed which now has two seams. And the two pieces of sheet metal which form this cylinder can very easily be separated from one another by pressing in on either of the two seams and then separating the side edges making up that seam.

Thus my foraged fuel stove consists of two hollow semi-cylinders joined at their side edges. The first hollow semi-cylinder consists of a first 10"×13" section of sheet metal. Likewise the second hollow semi-cylinder consists of a second 10"×13" section of sheet metal. These two 10"×13" sections of sheet metal are joined to each other at their side edges by means of the interlockable mechanism at the side edges. Thus, there is formed a ten-inch high hollow cylinder having an eight-inch diameter. One, or preferably both, of the two sections of semi-cylindrical sheet metal making up the stove have a series of equally spaced openings in them for ventilation. Preferably these openings are rectangular in shape, but for stylistic reasons circular or oval shaped openings may be preferred for some markets. Each section that has these openings will also have means for adjusting the air intake incorporated into the wall of the section. Preferably, this means for adjusting air intake will consist of a sliding sheet large enough to cover the openings. This sliding sheet will have openings to match the openings in the section of semi-cylindrical sheet metal. This sliding sheet can be loosely fastened to the interior wall using rivets or the like, thus allowing the sliding sheet to be easily moved. Thus by moving the sliding sheet about the width of an opening all the openings may quickly be covered or uncovered. Thus the sliding sheet has an open position in which all the openings are revealed and a closed position in which all the openings are covered. In this way the amount of air allowed to the interior of the assembled stove can be easily controlled.

In order to facilitate moving the sliding sheet back and forth, a vent handle is affixed to the sliding sheet. A hole is cut in the wall of each section having a sliding sheet to allow the vent handle to protrude through the wall so that the vent handle can be easily operated from outside the stove. This vent handle is of L-shaped construction. In one of its positions, it extends straight outwardly, thus allowing the sliding sheet to be easily moved thereby. Then the vent handle can be rotated 180 degrees and it will extend straight downward thus not being in the way when the stove is folded for storage.

The stove further consists of two adjustable grill wires for supporting pots of various sizes placed on top of the stove, and for supporting cooking utensils hung from them just outside the perimeter of the stove. Each of the grill wires has a first attached end which is movably attached to the upper end of the wall of the hollow cylinder. The second end of each of the grill wires terminates in a hook which is used to secure the two sections of the stove after it has been disassembled. The length of each of the grill wires is greater than the diameter of the hollow cylinder, whereby when the grill wires are positioned across the upper circular opening of the assembled stove, a support is provided for cooking utensils to be placed thereon and to be hung from the second ends thereof. In addition, the length of each of the grill wires is greater than the height of the hollow cylinder, whereby the hooks at the ends of the two grill wires can be attached to the lower end of a wall of the hollow cylinder, which is useful for securing the stove after it has been disassembled.

There are two key features which distinguish this foraged fuel stove from all previous disassemblable portable stoves. The first feature is that the parts which make up this stove are permanently interconnected to form a single unit so that parts will not become detached, misplaced, or lost. This feature is accomplished by using inverted square-shaped guiding pivot wires to join the two semi-cylindrical sections of the stove (thus making the stove a one-piece construction) and to allow the two sections of the stove to be rotated with respect to one another. These guiding pivot wires help hold the assembled stove together and provide additional support for pots and pans placed on the stove. Further, these guiding pivot wires allow the two sections of the stove to be separated just enough so that the two sections of the stove can be rotated with respect to one another thus facilitating easy assembly and disassembly of the stove but without allowing any parts to become disconnected from the stove. In other words, the guiding pivot wires allow assembly and disassembly to proceed smoothly but do not allow the sections of the stove to be moved more than a certain distance from each other, and thus possibly be misplaced. The guiding pivot wires guide the assembling and disassembling processes.

The second key feature which distinguishes this foraged fuel stove from all previous disassemblable portable stoves is the compactness of the stove after disassembly and the unusual way it minimizes storage requirements. Upon being disassembled, the first section of the stove nests within the concavity of the second section. The hooks at the end of the two grill wires are then hooked over the bottom edges of the two sections and used to secure them tightly together thus causing the disassembled stove to occupy minimal space and to exhibit both a concavity and a convexity. It will then be found that the concavity of the disassembled stove has just the right shape for a sleeping pad to be fitted therein. In other words, the disassembled stove can be wrapped around a sleeping pad and thus not have to be placed in one's backpack. The volume of the stove when packed is approximately 1/15th the volume of the stove when it is assembled (<35 cu in/>500 cu in). This is the basis of the claim that the ratio of the volume of the assembled state of the stove to the volume of the disassembled state of the stove is greater than 12 to 1.

The above features are objects of this invention. Yet further objects are as follows:

An object of the instant invention is to provide a foraged fuel stove that is simple in construction, strong and sturdy, and easy to use. The stove should not break if dropped, and should be strong enough to support a 6 quart cast-iron Dutch oven.

A further object is to provide a foraged fuel stove that is economical in cost to manufacture.

A still further object is to provide a foraged fuel stove which occupies minimal space and can be carried outside of one's backpack, preferably to have a packed volume of less than 35 cubic inches. The stove should be flexible when disassembled so that it can be stowed around bundles of various diameters. The stove should be lightweight, and be quickly and easily set up when one arrives at one's camp site. Assembly of the stove should require no fastening hardware, and assembly/disassembly should be able to be performed in less than 20 seconds, even in sub-zero conditions when gloves need to be worn.

Still another object is to provide a foraged fuel stove which can boil one quart of water at an outdoor temperature of 0° F. in less than five minutes. Additionally, the stove should be efficient enough to burn wet wood.

A further object is to provide a stove which can use foraged fuel, so that one does not have to carry fuel with him. This gives significant savings in carried weight and volume.

Yet another object is to provide a stove with a large firebox. (A stove with a large firebox requires little tending to keep it lit.) The assembled volume should be greater than 500 cubic inches.

Still another object is to provide a stove with an adjustable grill to support small cans or cups. The grill should be such that utensils can be hung on the grill to keep them out of the dirt.

Another object is to provide a stove with air vent handles which can be locked in an operating position that helps keep them cool.

Still another object is to provide a stove which can be used as a campfire starter such that when one is finished cooking, one need only lift the stove up and set it aside. The coals will then be in place for use as a campfire.

Yet another object is to provide a stove which cools quickly so that it will be ready to be packed shortly after it has been used.

Still another object is to provide a stove which leaves no earth burn scars.

A still further object is to provide a stove which can be used as a self-starting charcoal grill. It should have such efficiency that the charcoal can be lit with newspaper.

Yet another object is to provide a stove which fits existing products like grill tops and stove-top bread toasters.

Still another object is to provide a stove which does not require a windscreen to operate under harsh conditions.

Yet another object is to provide a stove which does not require periodic maintenance or special maintenance kits to keep it operational.

Yet another object is to provide a foraged fuel stove where the stove can be brought from a vents closed state to a fully vented state with minimal movement of the vent handles attached to the stove. (Minimal movement would be no more than about an inch of movement from fully opened to fully damped.)

A still further object is to provide a foraged fuel stove which is of essentially one-piece construction. Thus there are no parts to misplace or accidentally leave at home or at a campsite.

These and other objects, features, aspects, and advantages of the present invention will become better understood with regard to the following description, appended claims, and accompanying drawings and will be otherwise apparent to those skilled in the art.

For the purpose of illustration of this invention, a preferred embodiment is shown in the accompanying drawings. It is to be understood that this is for the purpose of example only and that the invention is not limited thereto.

4.0 BRIEF DESCRIPTION OF THE DRAWINGS

5.0 DESCRIPTION

5.1 Overview

The foraged fuel stove is constructed from two 10"×13" semi-cylindrical shaped metal sheets, steel wire, some small pieces of sheet metal and rivets. The preferred material for the stove is 28 gauge steel sheet metal. The stove can be easily constructed in different sizes. The size used in this application is for a stove approximately 10" tall and 8" in diameter.

The 10"×13" metal sheets are folded along their 10" side edges and joined, such that the seams between the two thus joined sheets are releasable locking seams. Each sheet is a side of the firebox cylinder. In each piece, a series of air vents are cut to provide air to the fire. Each piece has a sliding sheet having spaced apertures. The sliding sheet slides horizontally and is used to control the air flow and thus the temperature output of the stove. Each sliding sheet has a vent handle formed from steel wire. Two steel grill wires are movably attached to the top of the cylinder so that the distance between them can be adjusted to provide a stable support for containers of various sizes. These wires serve a secondary function of locking the unit together when it is stowed. The interlockable side edges of each semi-cylinder are what facilitate the rapid assembly and disassembly of the stove. The two semi-cylinders can easily be separated by flexing their seams inwardly toward the center of the cylinder and pushing them apart.

When the stove is separated and stowed, it can be packed by rolling it up as part of a sleeping bag pad or similar bundle. This provides a unique packing option by employing space that is normally unused.

5.2 Detailed Description of the Elements

5.2.1 Description of the Foraged Fuel Stove

Figure 1:
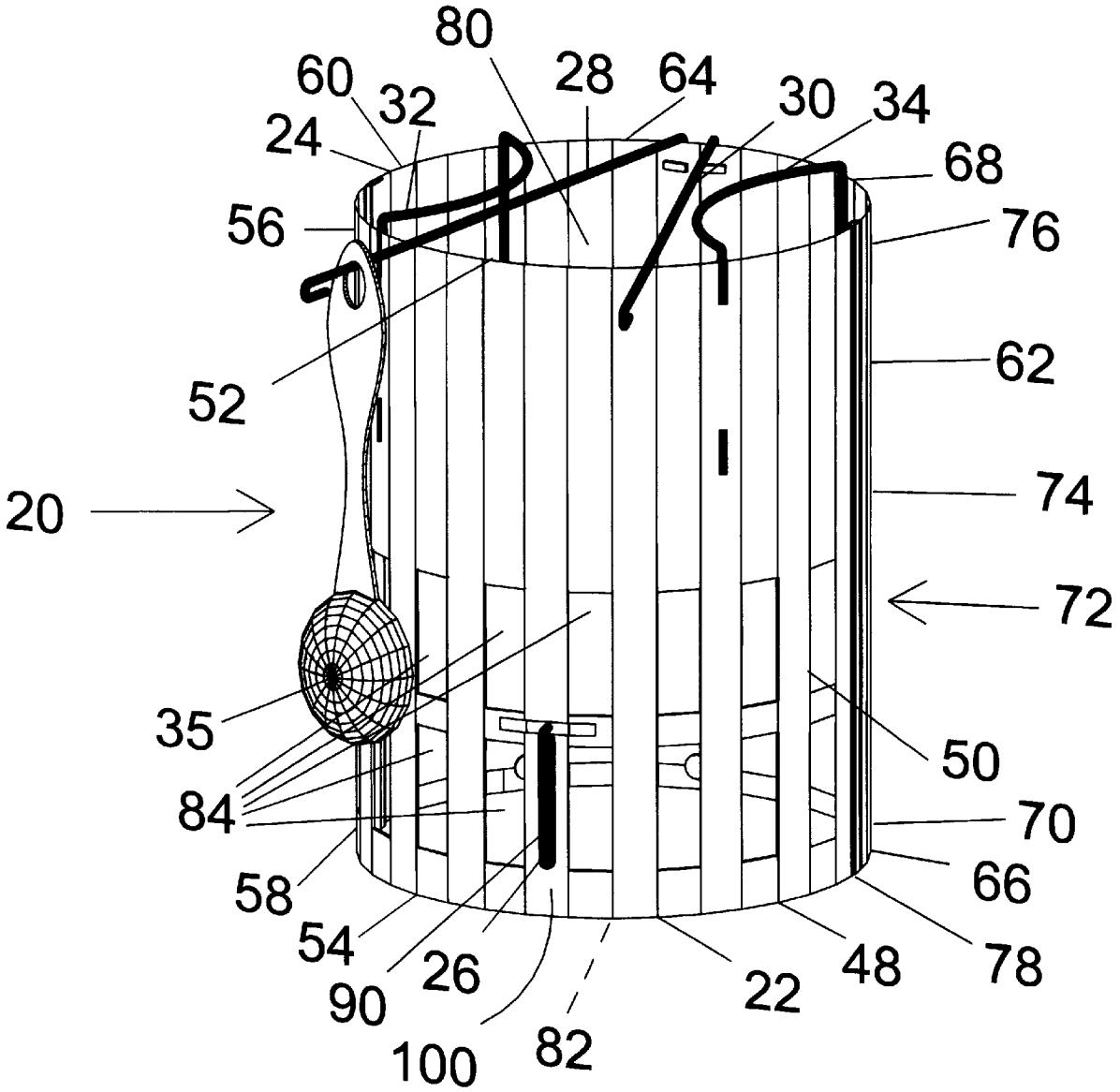
FIG. 1 shows a front perspective view of the preferred embodiment with the sliding vent sheet in the air vents open position.
Figure 2:
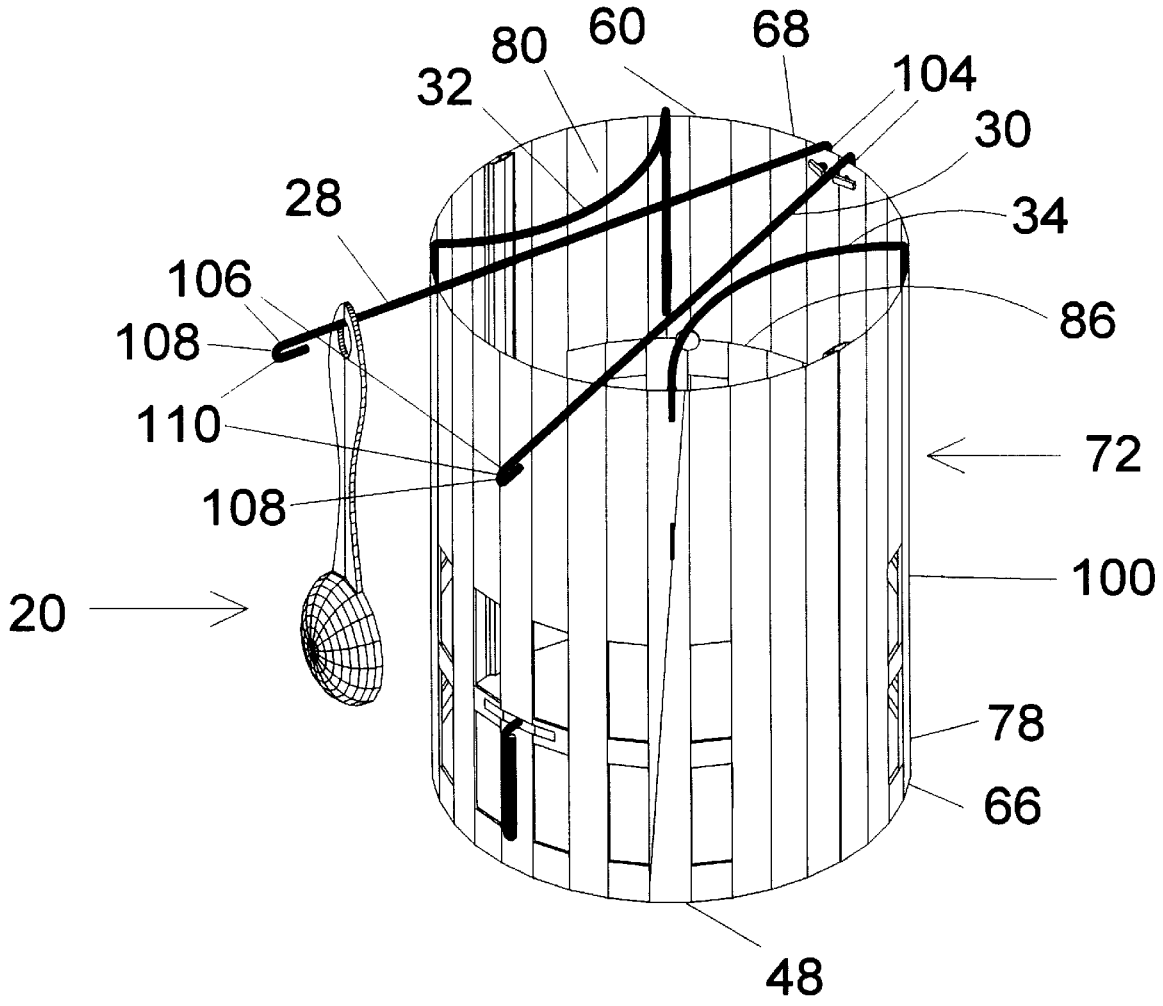
FIG. 2 shows an isometric view of the preferred embodiment with the sliding vent sheet in the air vents open position.

Turning now descriptively to the drawings, in which similar reference characters denote similar elements throughout the several views, FIG. 1 illustrates a front perspective view of the preferred embodiment of a foraged fuel stove with the sliding vent sheet in the air vents open position. This foraged fuel stove has an assembled state and it a disassembled state. As best seen in FIGS. 1 and 2, the foraged fuel stove, generally shown by reference numeral 20, consists of two joinable hollow semi-cylinders 22, 24, means for adjusting the air intake 26, two grill wires 28, 30, and two guiding pivot wires 32, 34. A spoon 35 is shown hanging from one of the grill wires.

Figure 15:
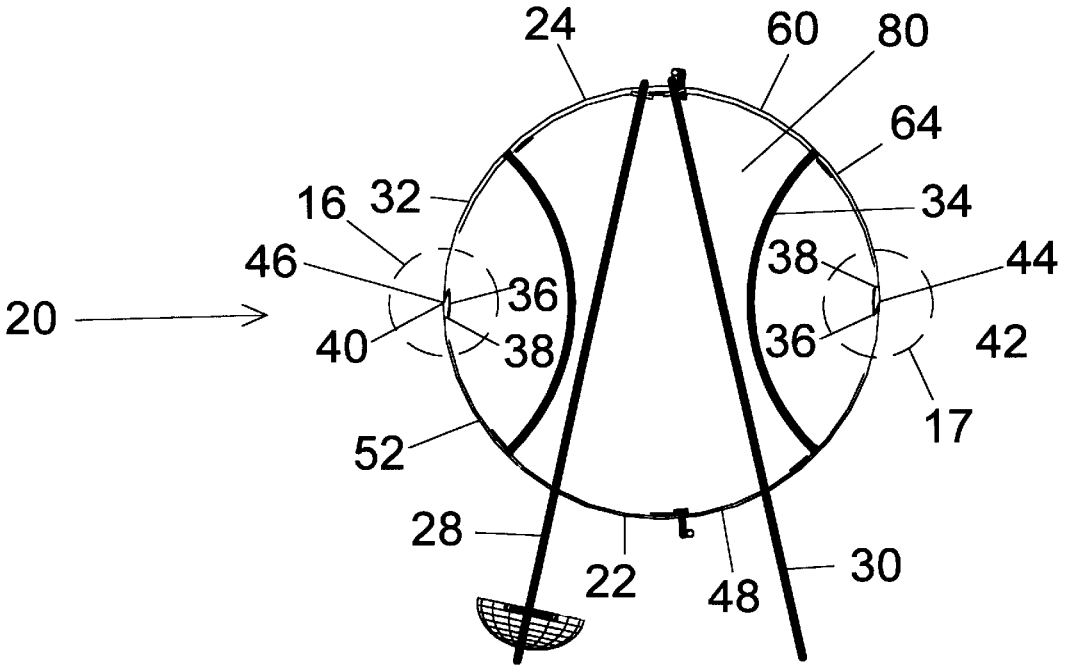
FIG. 15 shows a top view of the preferred embodiment illustrating how the two interlockable sections of the stove are held together at the seams when in the assembled state.
Figure 16:
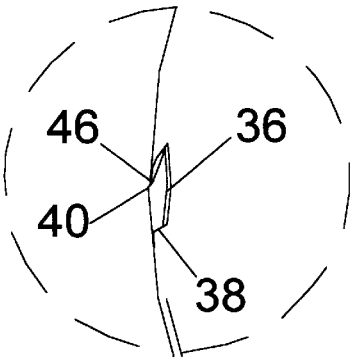
FIG. 16 shows an enlarged view of dashed circle 16 of FIG. 15.
Figure 17:
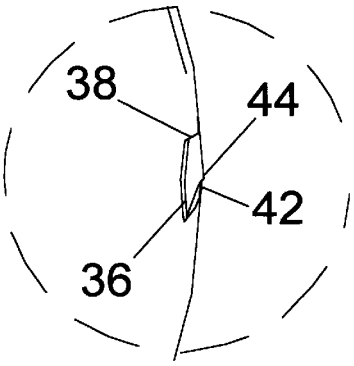
FIG. 17 shows an enlarged view of dashed circle 17 of FIG. 15.

As best shown in FIGS. 15, 16, and 17, the two hollow semi-cylinders 22, 24 are joinable at their side edges 40, 42, 44, 46. The first hollow semi-cylinder 22 consists of a first section of flexible 10"×13" metal sheet with interlockable side edges. This hollow semi-cylinder will hereinafter be referred to as the first stove section 48. It will be noted that in a semi-cylindrical section of 10"×13" metal sheet with interlockable side edges, one side edge 40 terminates in a V-shaped bend 36 and the other side edge 42 has a matching clasp-like structure 38. The first stove section 48 has a wall 50 which is about ten inches in height. The edges 52, 54 of the upper and lower ends 56, 58 of the wall are semicircular in shape.

The second hollow semi-cylinder 24 consists of a second section of flexible 10 "×13" metal sheet with interlockable side edges. This hollow semi-cylinder will hereinafter be referred to as the second stove section 60. It will again be noted that in a semi-cylindrical section of 10"×13" metal sheet with interlockable side edges, one side edge 44 terminates in a V-shaped bend 36 and the other side edge 46 has a matching clasp-like structure 38. The second stove section 60 has a wall 62 with the same height as the wall 50 of the first stove section 48. The edges 64, 66 of the upper and lower ends of the wall 68, 70 are semicircular in shape. Consequently, as best seen in FIGS. 15, 16, and 17, the second stove section 60 is removably joinable to the first stove section 48 by means of the interlockable V-shaped bend 36 and matching clasp-like structure 38 along each of their respective side edges. FIGS. 15, 16, and 17 best show how the V-shaped bends and the matching clasp-like structures along the side edges hold the two sections of stove together. Thus from these two semi-cylindrical sections 22, 24 there can be formed a single hollow cylinder 72 with a wall 74 whose upper and lower ends 76, 78 have edges defining circular openings 80, 82. This single hollow cylinder shall hereinafter be referred to as the stove cylinder 72.

Figure 3:
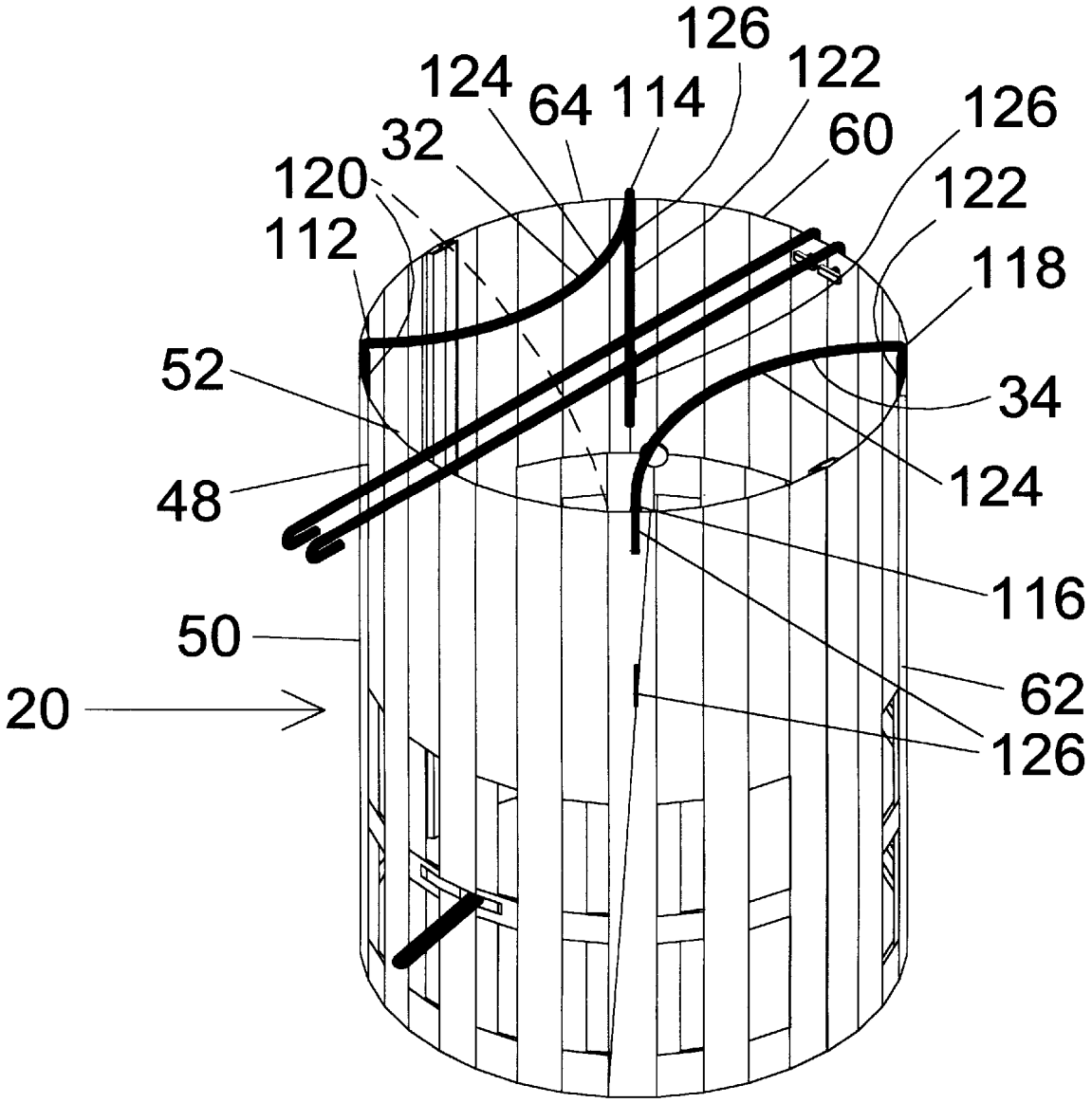
FIG. 3 shows an isometric view of the preferred embodiment with the air vents of the sliding vent sheet in a partially opened, partially closed position.
Figure 4:
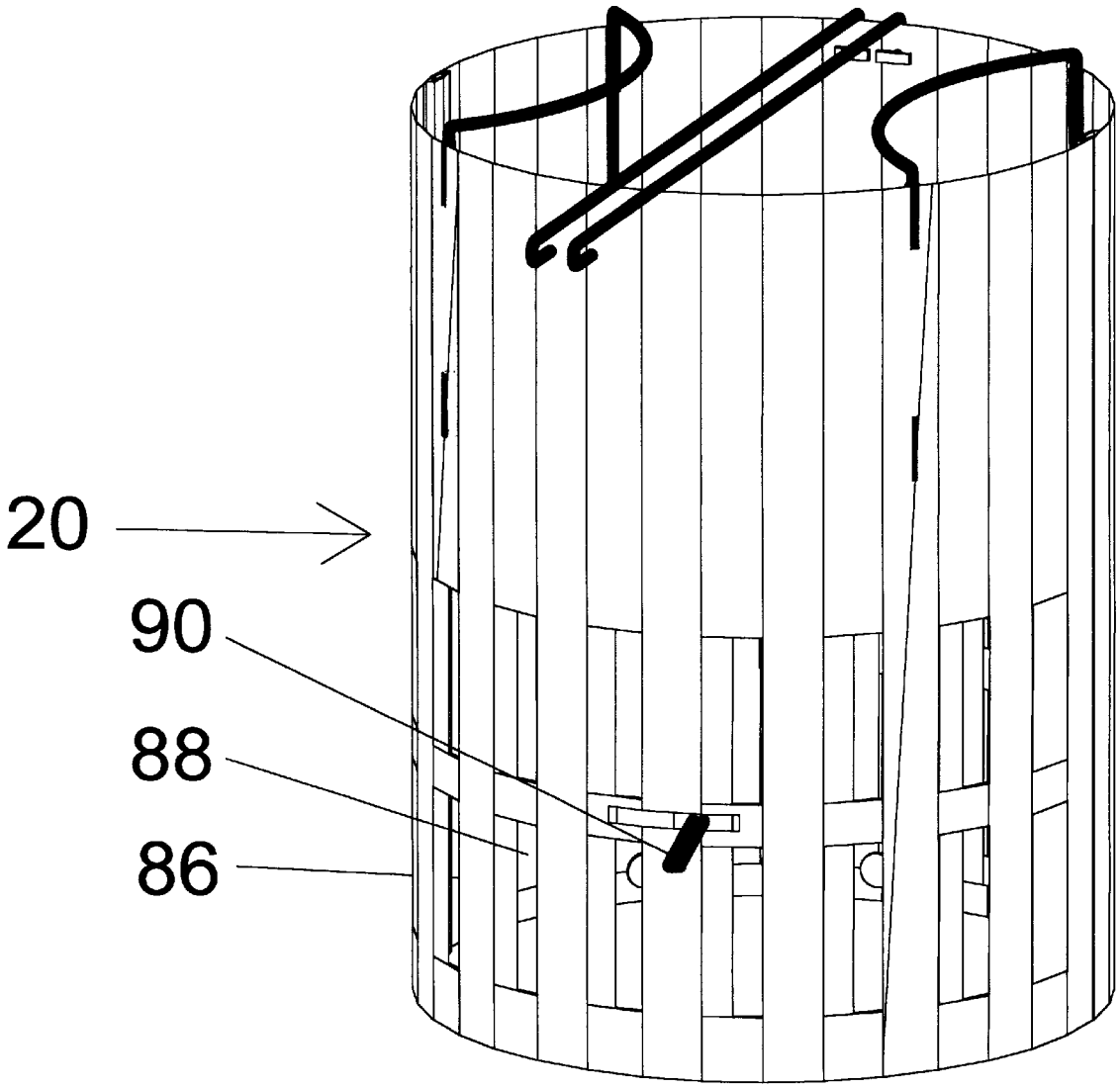
FIG. 4 shows a front perspective view of the preferred embodiment with the air vents of the sliding vent sheet in a partially opened, partially closed position.
Figure 5:
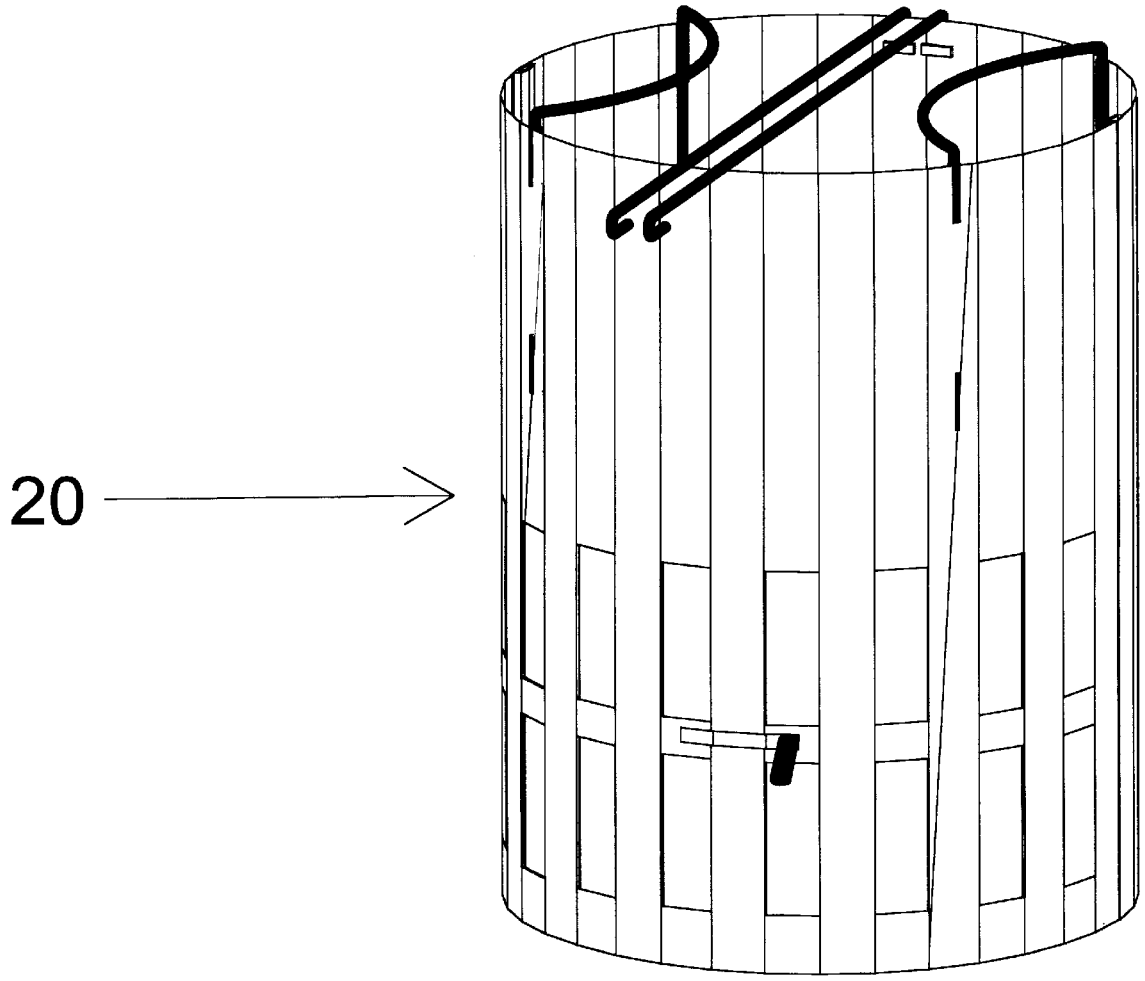
FIG. 5 shows a front perspective view of the preferred embodiment with the air vents of the sliding vent sheet in a fully closed position.
Figure 6:
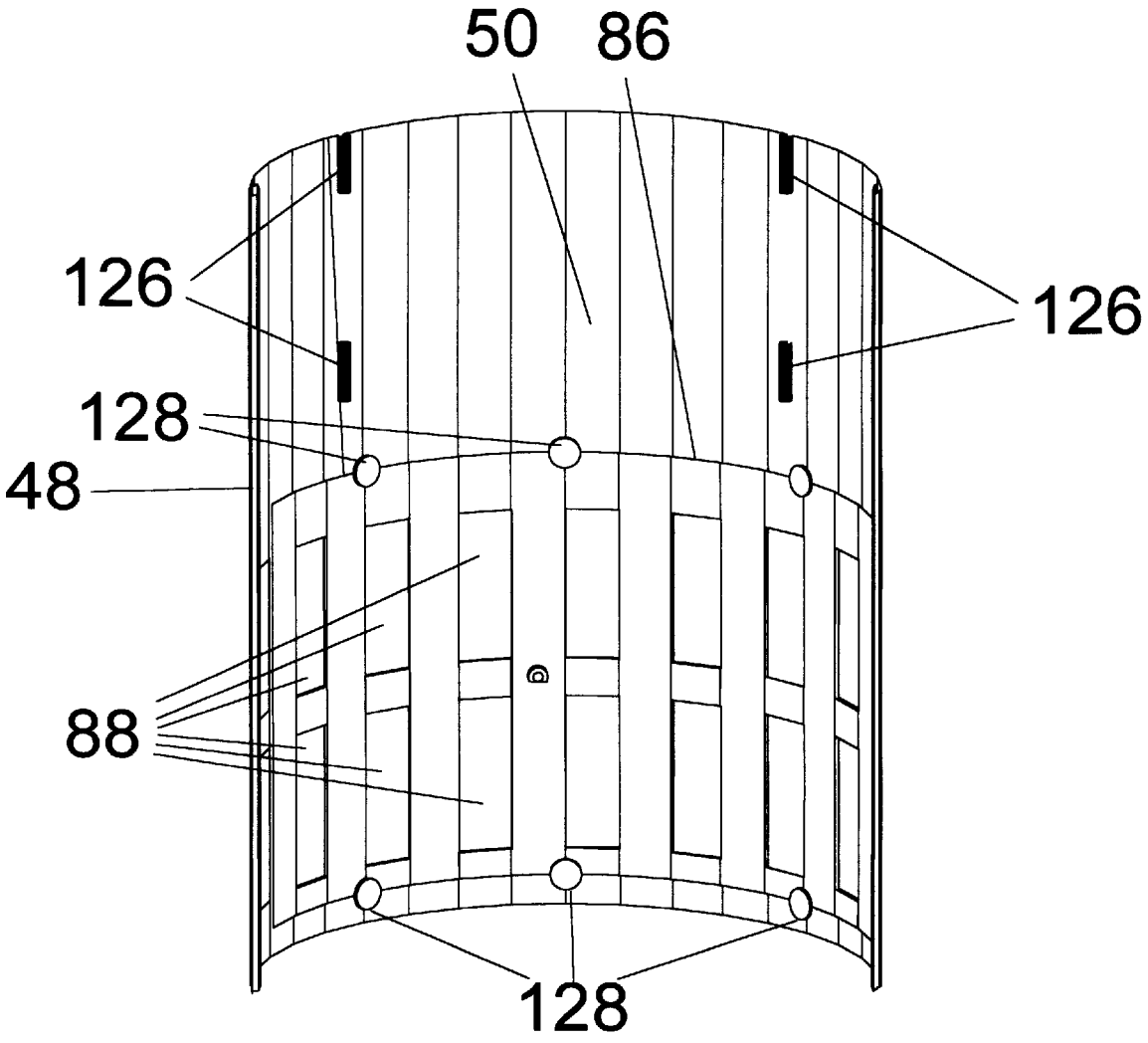
FIG. 6 shows a front perspective view of one of the semi-cylindrical sections of the preferred embodiment with the grill wires removed.
Figure 18:
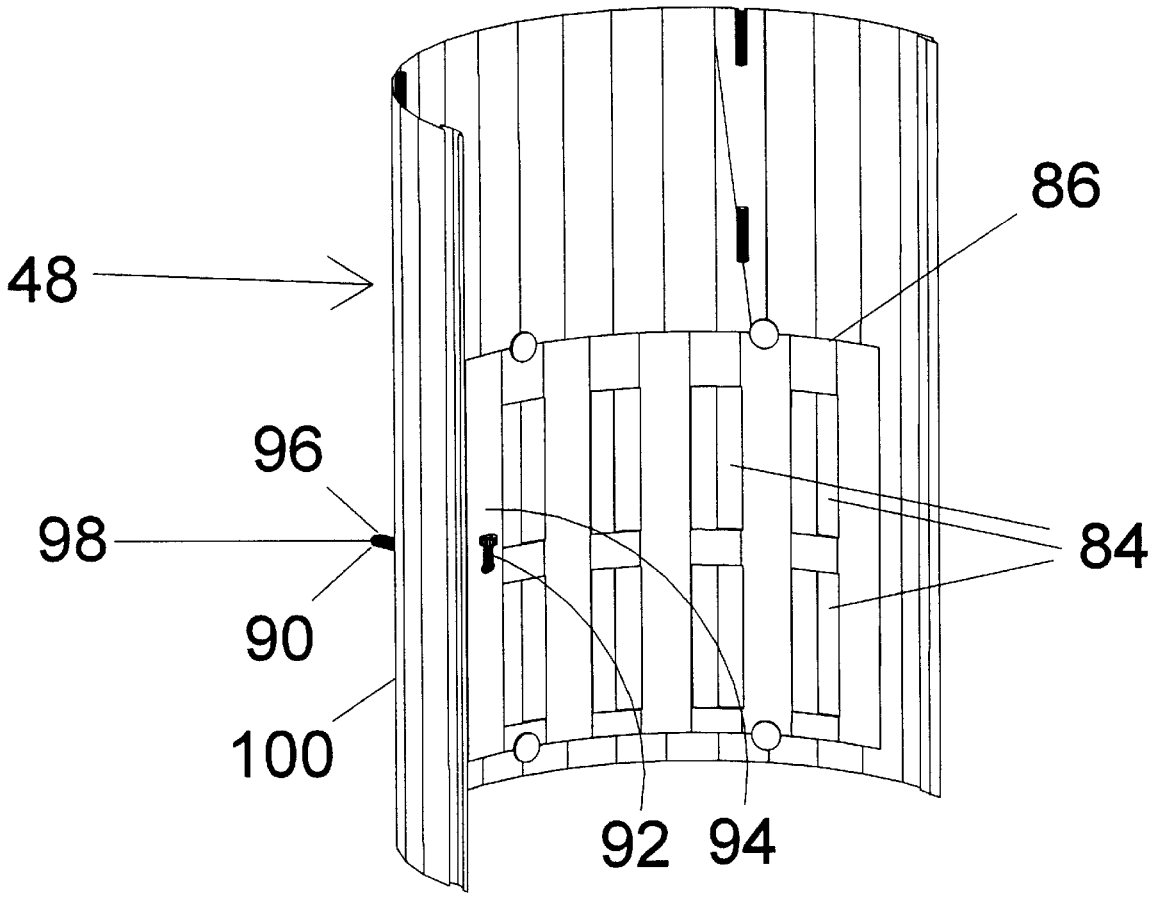
FIG. 18 shows a front perspective view of the rear semi-cylindrical section of the preferred embodiment illustrating the vent handle of a sliding vent sheet supported in its extended outward position.

The means for adjusting the air intake 26 of the foraged fuel stove 20 is incorporated into at least one of aforementioned stove sections 48, 60. Preferably the means for adjusting the air intake 26 consists of a series of spaced openings 84 in the walls of each of the stove sections 50, 62 near the lower ends of their walls 58, 70, and a sliding sheet 86 (best seen in FIG. 6) slidably attached to the walls 50, 62 of each of the stove sections 48, 60 in the vicinity of the openings 84. Preferably rivets 128 or the like fastened to the inside wall of each stove section will loosely hold the sliding sheet in position and will allow the sliding sheet to slide freely to the right or left. These rivets 128 are best shown in FIG. 6. The distance between successive wall openings should be at least the width of the widest part of a wall opening so that the hereinafter described sliding sheet can be moved the width of a wall opening to either fully cover or fully uncover all the wall openings. The sliding sheets 86, 86 have openings 88 in them to match the openings 84 in the walls 50, 62 of the stove sections 48, 60. A sliding sheet 86 can be slid to its fully open position in which all the wall openings 84 are uncovered and a closed position in which all of the wall openings 84 are covered. (FIG. 6 shows a section of the stove with the sliding sheet in the fully open position. FIG. 5 shows the stove with the sliding sheet in the fully closed position. FIGS. 3 and 4 shows the stove with the sliding sheet in a position intermediate between the fully open and fully closed positions.) In this way, the amount of air allowed to the interior of the stove cylinder 72 of the assembled stove 20 can be controlled. Affixed to each of the sliding sheets 86 is a vent handle 90 by which the sliding sheets 86, 86 can be slidably moved from their fully open position to their fully closed position or to any intermediate position in which the wall openings 84 are only partially covered. Preferably, as best shown in FIG. 18, these vent handles 90, 90 are substantially L-shaped and are rotatably affixed to the sliding sheets 86, 86. When an L-shaped vent handle 90 is rotated so that the lower leg 92 of the L of the vent handle 90 is pointing upward, this leg 92 can be rested on the inner wall of the sliding sheet 94 which, thus provides such support for the lower leg 92 of the L of the vent handle 90, that the upper leg 96 of the vent handle 90 is supported in an extended outward position. In this position, the tip 98 of the vent handle 90 can be easily used to slide the sliding sheet to the right or the left, thus varying the amount of air which enters the stove through the openings 84 in its wall. In addition, in this position the tip 98 of the vent handle 90, being at a distance from the hot stove wall will be somewhat cooler to the touch than if the vent handle 90 were not so extended. Then when one is ready to disassemble the stove, the vent handle 90 would be rotated 180 degrees (one half turn). Now it assumes a downward orientation and is thus against the outer wall 100 of the stove so that it will be out of the way and in the proper position for storage.

The two grill wires 28, 30 each have a first attached end 104 and a second end 106 having means for attaching to the end of a wall 108. The preferred means for attaching to the end of a wall 108 is via hooks 110 attached to, or preferably integrally formed at, the ends 106 of the grill wires 28, 30. The first attached ends 104, 104 of the grill wires 28, 30 are movably attached to the upper end of the wall 68 of one of the stove sections. The length of each of the grill wires 28, 30 is greater than the diameter of the assembled stove 72. Thus when the two grill wires 28, 30 are positioned across the upper circular opening 80 of the assembled stove, a support is provided for cooking utensils to be placed thereon and to be hung from the second ends 106, 106 thereof.

Figure 7:
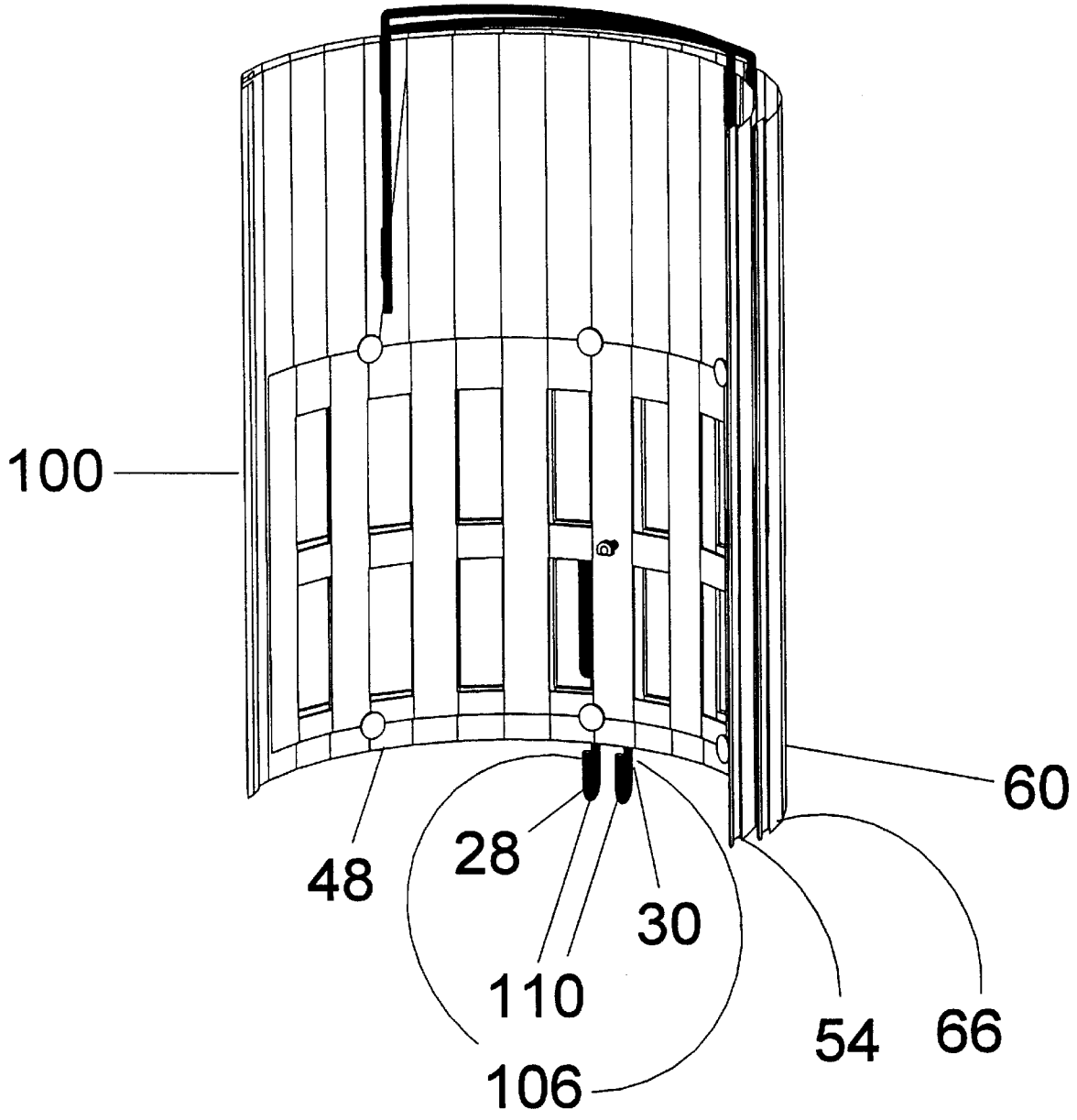
FIG. 7 shows a front perspective view of the disassembled stove before being secured with the two securing wires.
Figure 8:
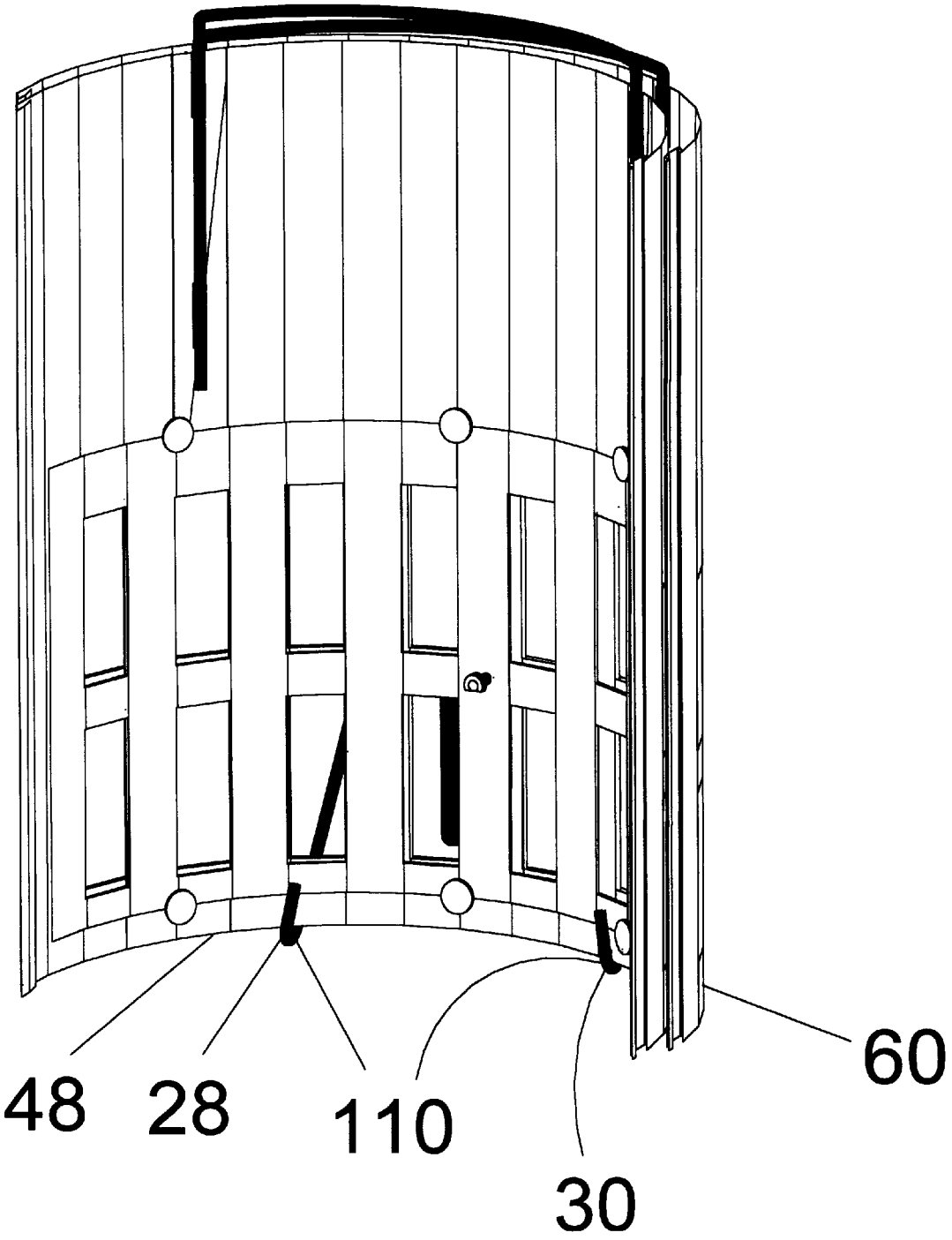
FIG. 8 shows a front perspective view of the disassembled stove secured with the two securing wires.

Further, the length of each of the grill wires 28, 30 is greater than the height of the stove wall 100. Thus the two grill wires 28, 30 can be attached via their hooks 110, 110 to the edge 66 of the lower end of a wall 78 of the stove. Preferably, as shown in FIGS. 7 and 8, the length of each of the grill wires 28, 30 is sufficiently greater than the height of the wall 100 of the stove that the hooks 110, 110 at the ends of the grill wires 28, 30 can be used to secure the disassembled foraged fuel stove by being hooked over the edges of the lower ends 54, 66 of the nested first and second stove sections 48, 60 of the disassembled stove and spread apart.

Figure 10:
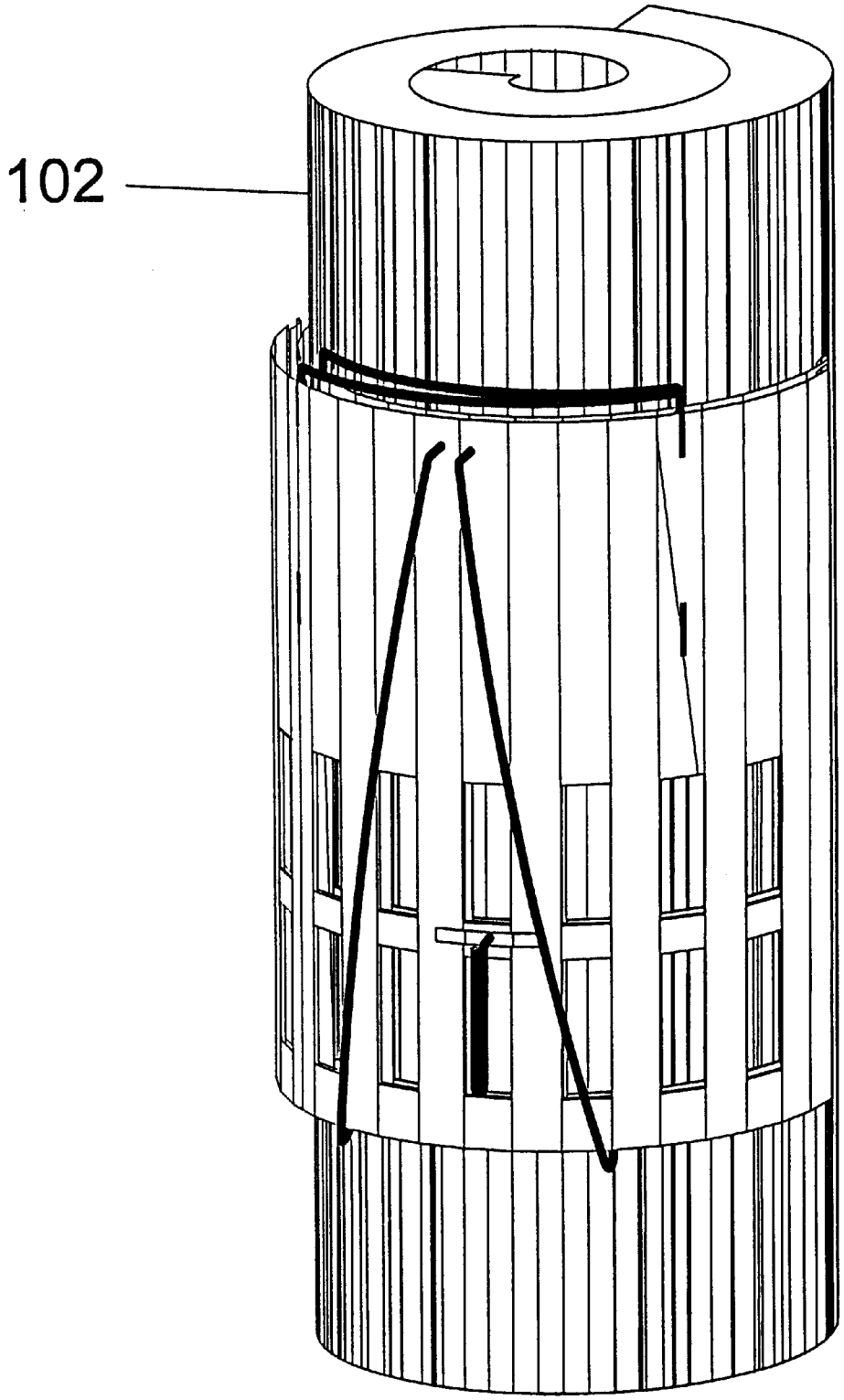
FIG. 10 shows a rear perspective view of the preferred embodiment wrapped around a bed roll.

In order to facilitate storage of the disassembled foraged fuel stove, the two stove sections 48, 60 should be made so that the curvatures of the two stove sections will be substantially identical. When this is the case, one of the stove sections can be nested within the concavity of the other opened stove section. Then when the hooks 110, 110 at the unattached ends 106, 106 of the grill wires 28, 30 are used to securely fasten together the two nested stove sections, the concavity on one side of the bound together stove sections is such that a rolled up sleeping pad 102 can be nested within the concavity. In this way the disassembled stove occupies minimal space and can be carried on the outside of one's backpack. This is illustrated in FIG. 10.

As previously mentioned, the two guiding pivot wires 32, 34 make my stove truly one-piece construction. As shown in FIG. 3, the first end of the first guiding pivot wire 112 is movably affixed to the first stove section 48 near its upper edge 52, and the second end of the first guiding pivot wire 114 is movably affixed to the second stove section 60 near its upper edge 64. Likewise, the first end of the second guiding pivot wire 116 is movably affixed to the first stove section 48 near its upper edge 52, and the second end of the second guiding pivot wire 118 is movably affixed to the second stove section 60 near its upper edge 64, These guiding pivot wires 32, 34 should be made of sufficient length that the foraged fuel stove can be easily assembled and disassembled. Preferably, as shown in FIGS. 3 and 4, the guiding pivot wires 32, 34 should be constructed such that each guiding pivot wire has two legs 120, 122 and a curved crossbar 124 which connects the two legs 120, 122. Thus, each guiding pivot wire 32, 34 somewhat resembles an upside-down squared-off U. In my preferred embodiment, the side walls 50, 62 of each of the two stove sections 48, 60 have channels 126 or the like for holding the legs 120, 122 of the guiding pivot wires 32, 34. One leg 120 of the first guiding pivot wire 32 is in a channel 126 of the first stove section 48, and the other leg 122 of the first guiding pivot wire 32 is in a corresponding channel 126 in the wall of the second stove section 60. Likewise, one leg 120 of the second guiding pivot wire 34 is in a channel 126 of the first stove section 48, and the other leg 122 of the second guiding pivot wire 34 is in a corresponding channel 126 in the wall of the second stove section 60. The crossbars 124 of the guiding pivot wires 32, 34 should be made of wire of sufficient length that they allow the foraged fuel stove to be easily assembled and disassembled. Channels 126 are best seen in FIG. 6.

Thus these two guiding pivot wires 32, 34 assist in holding the two stove sections 48, 60 together at their seams, and also provide additional support for items placed on the stove. In addition, these guiding pivot wires 32, 34 guide the assembly and disassembly processes, and ensure that no pieces of the stove become separated from the stove during disassembly.

Figure 19:
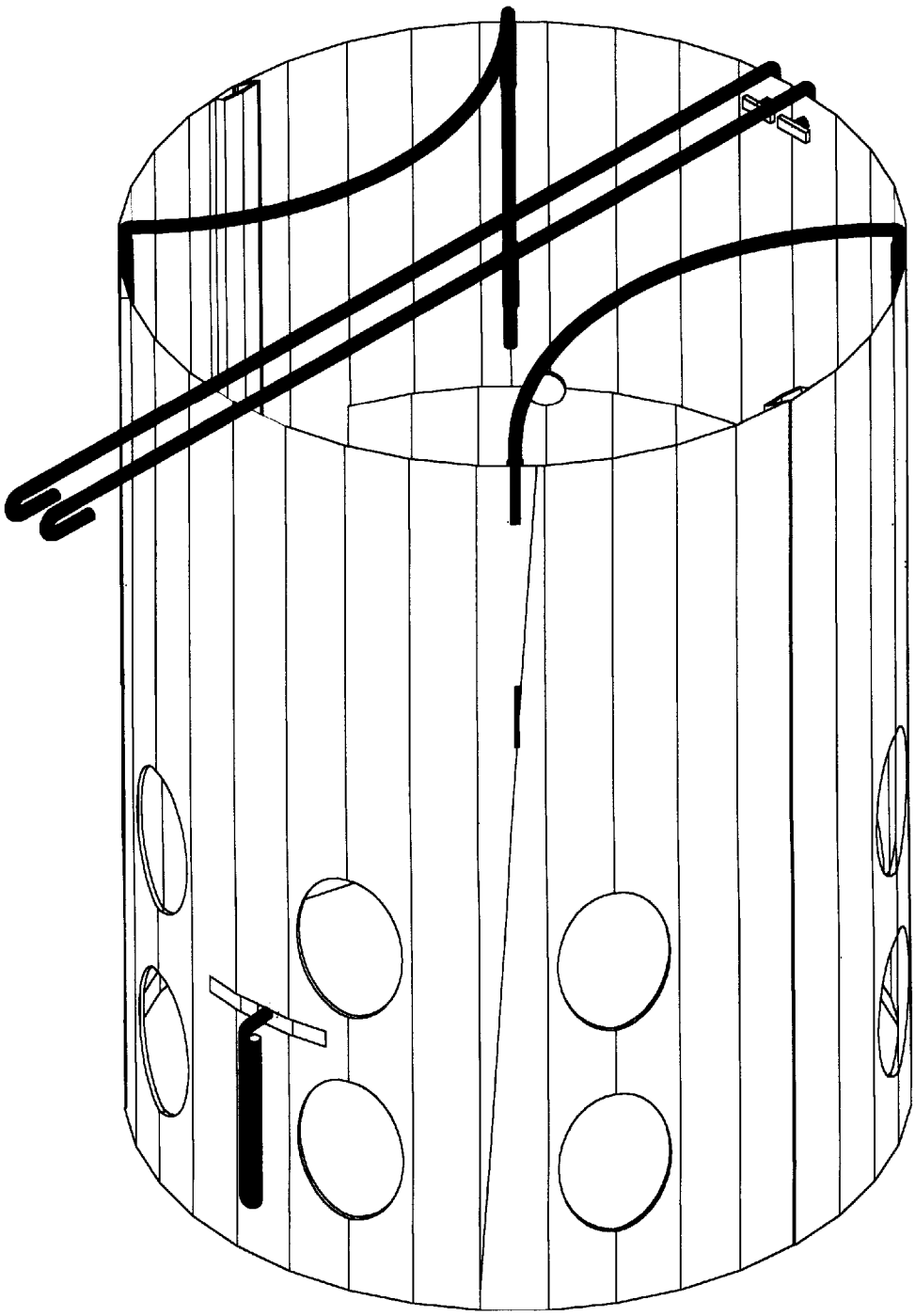
FIG. 19 shows a front isometric view of the nonpreferred embodiment with the sliding vent sheet in the air vents open position.

FIG. 19 shows another embodiment of my stove with oval rather than rectangular wall openings.

5.2.2 Method of Assembling the Foraged Fuel Stove

Figure 9:
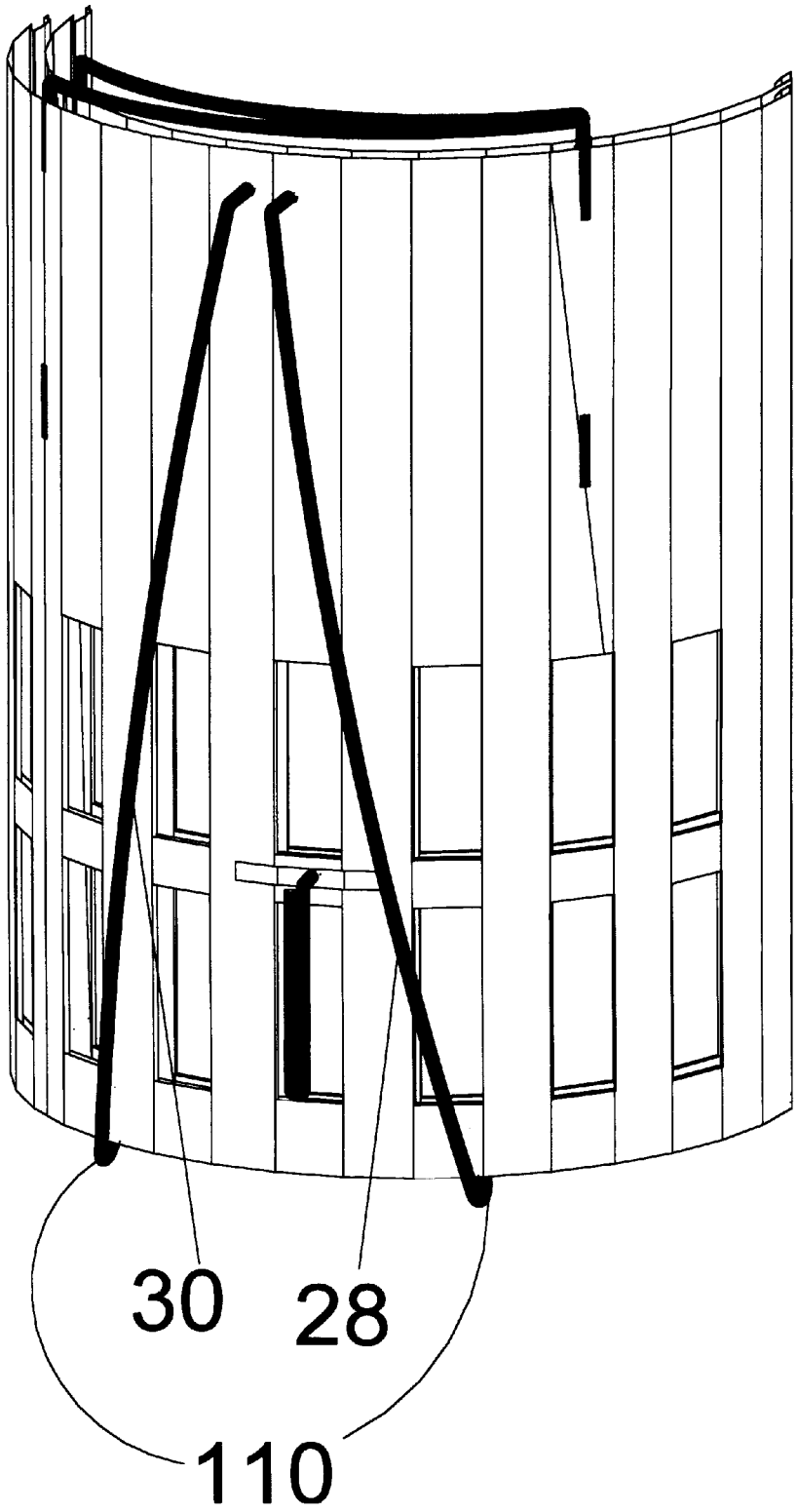
FIG. 9 shows a rear perspective view of FIG. 8.

The following method assumes that it is desired to assemble the stove after it had been properly folded for storage. The disassembled stove looks as shown in FIGS. 8 and 9. When assembled, the stove will look like FIG. 1. FIG. 3 shows the vent handle extended. A brief overview of the stove assembly process is as follows:

1. Release the hooked wires by pushing them together.
2. Separate the nested sections by peeling them apart. The front section will invert, causing the side edges to align.
3. Press the side seams together.
4. Swing the hooked wires onto the top of the stove and lock the vent handles in the horizontal position.

Figure 11:
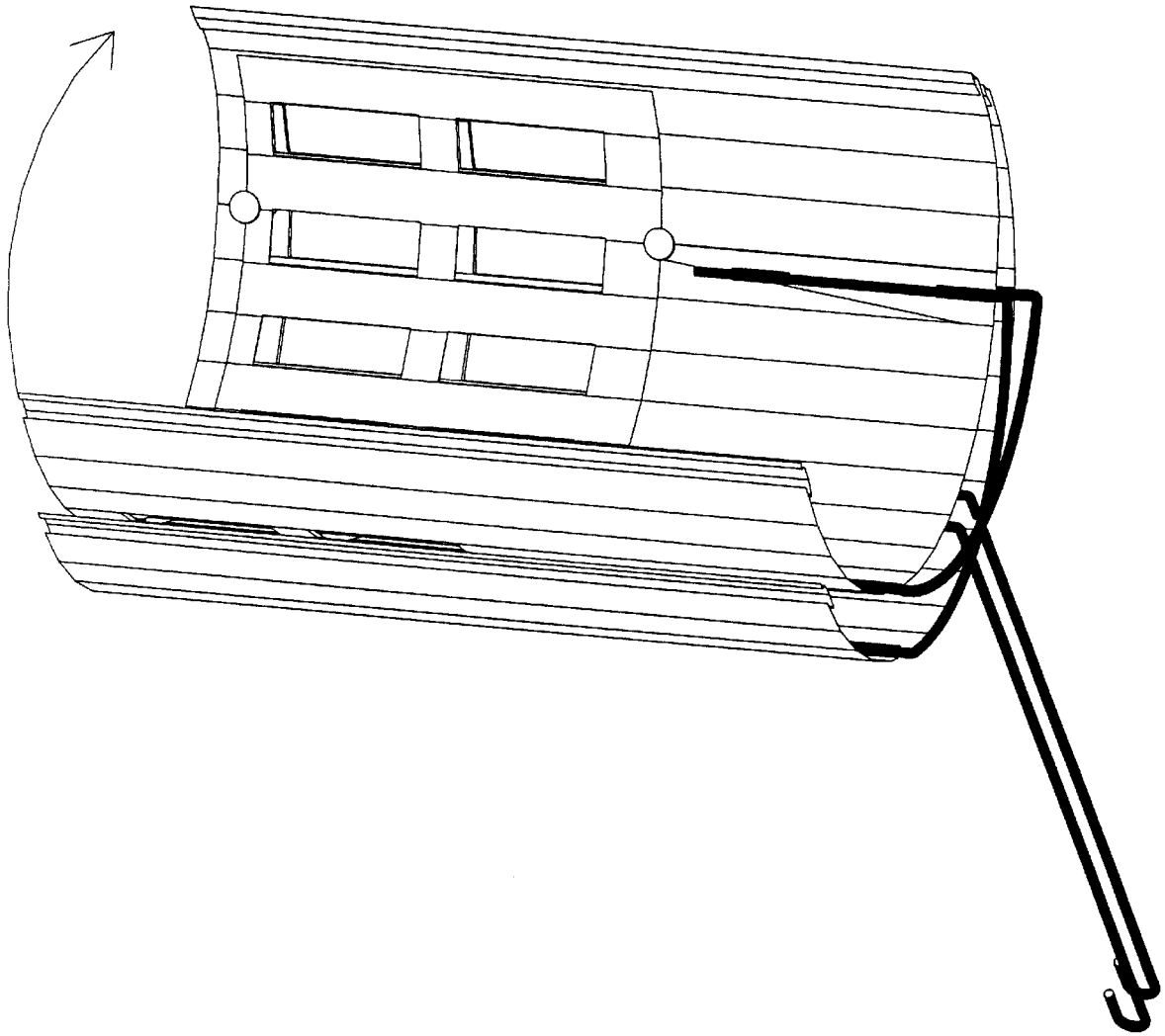
FIG. 11 shows a front perspective view of the preferred embodiment held on its side with the grill wires hanging down. The inner section of the preferred embodiment is shown in the process of being folded upward in order to assemble the stove.

A more detailed set of instructions for the preferred method for assembling the foraged fuel stove follows:

1. Hold the folded stove so that the outer surface of the convex side of the folded stove is level with the ground and facing downward. The grill wires 28, 30 will now be level with the ground and at the lowest point of the stove.
2. Move the hooks 110, 110 which hold together the lower ends of the nested stove sections 48, 60 toward each other (toward the center of the stove) and disengage the hooks 110, 110 from the edges 54 of the lower ends of the nested stove sections. Let the grill wires 28, 30 drop down as shown in FIG. 11.
3. Bend inwardly a wall of the inner nested stove section and pull the center of the outer surface of the inwardly bending wall away from the inner surface of the other stove section until only a side edge of the inwardly bending wall is in contact with the inner surface of the other stove section. Please note that one has to pull hard enough to overcome the spring tension of the top stove section. FIG. 11 also shows the nearest (to the observer) side edges of the two sections of the stove in the process of being separated.

Figure 12:
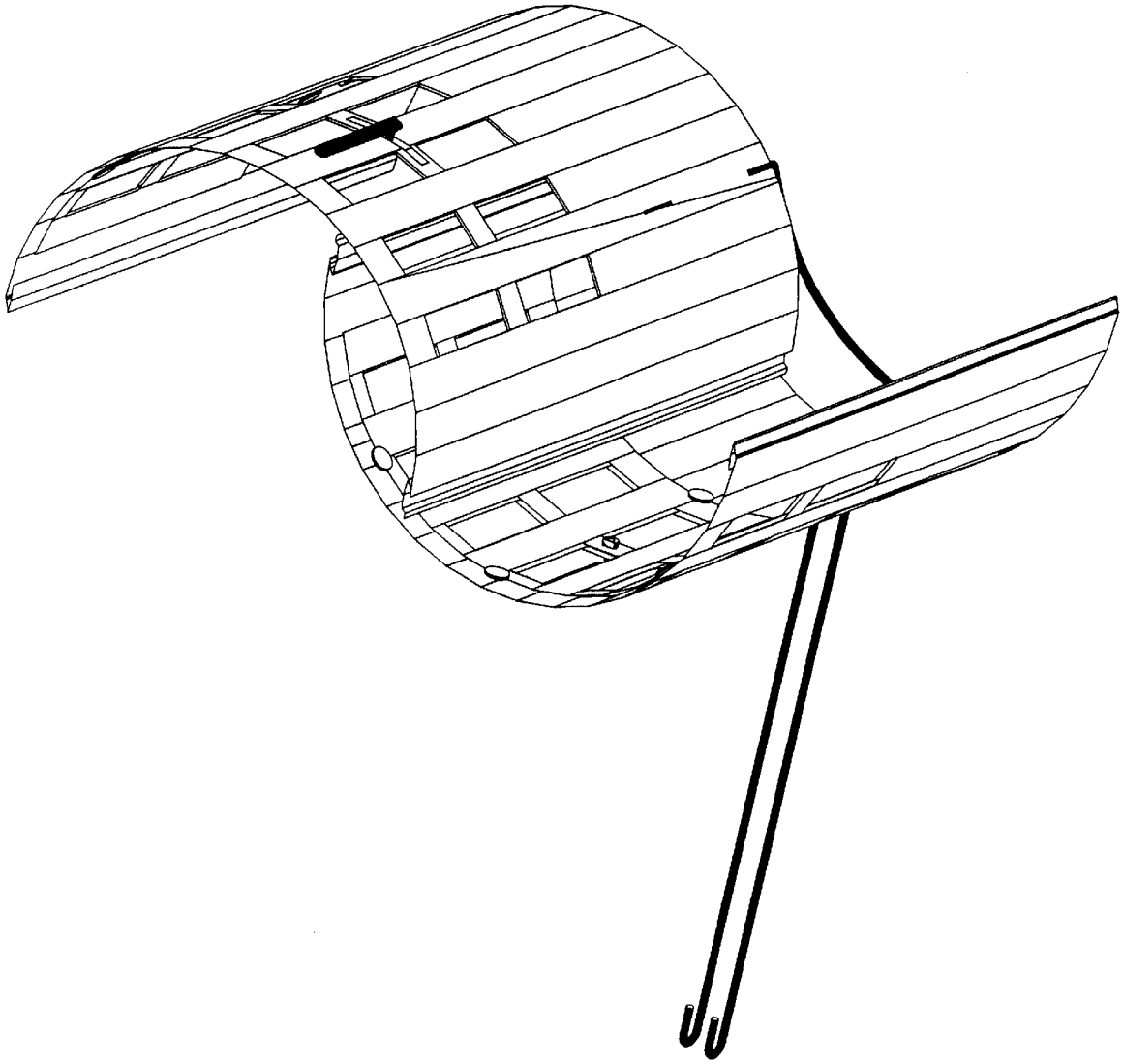
FIG. 12 shows a front perspective view of the preferred embodiment in an intermediate stage of assembly or disassembly.
Figure 13:
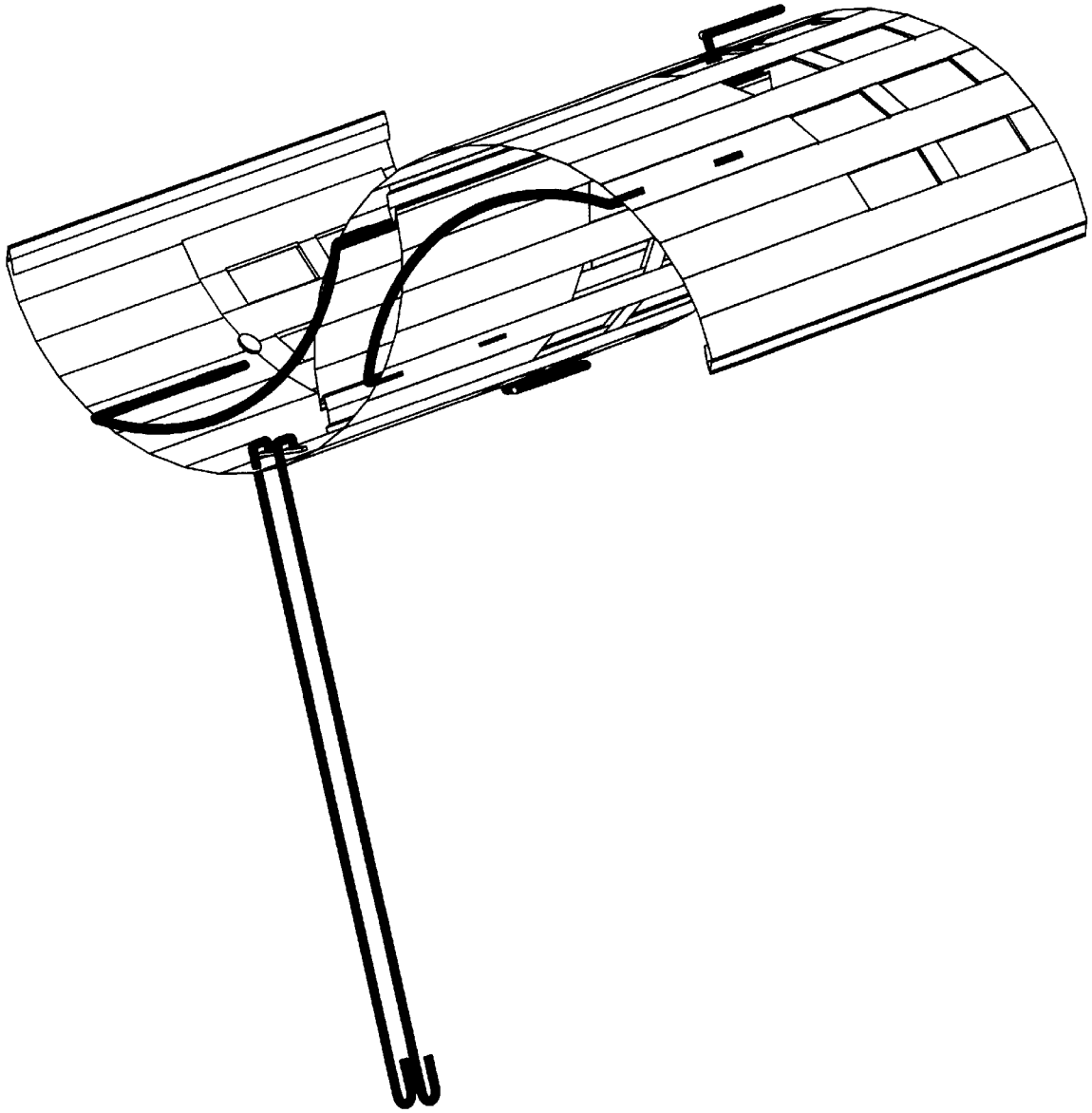
FIG. 13 shows a back view of FIG. 12.
Figure 14:
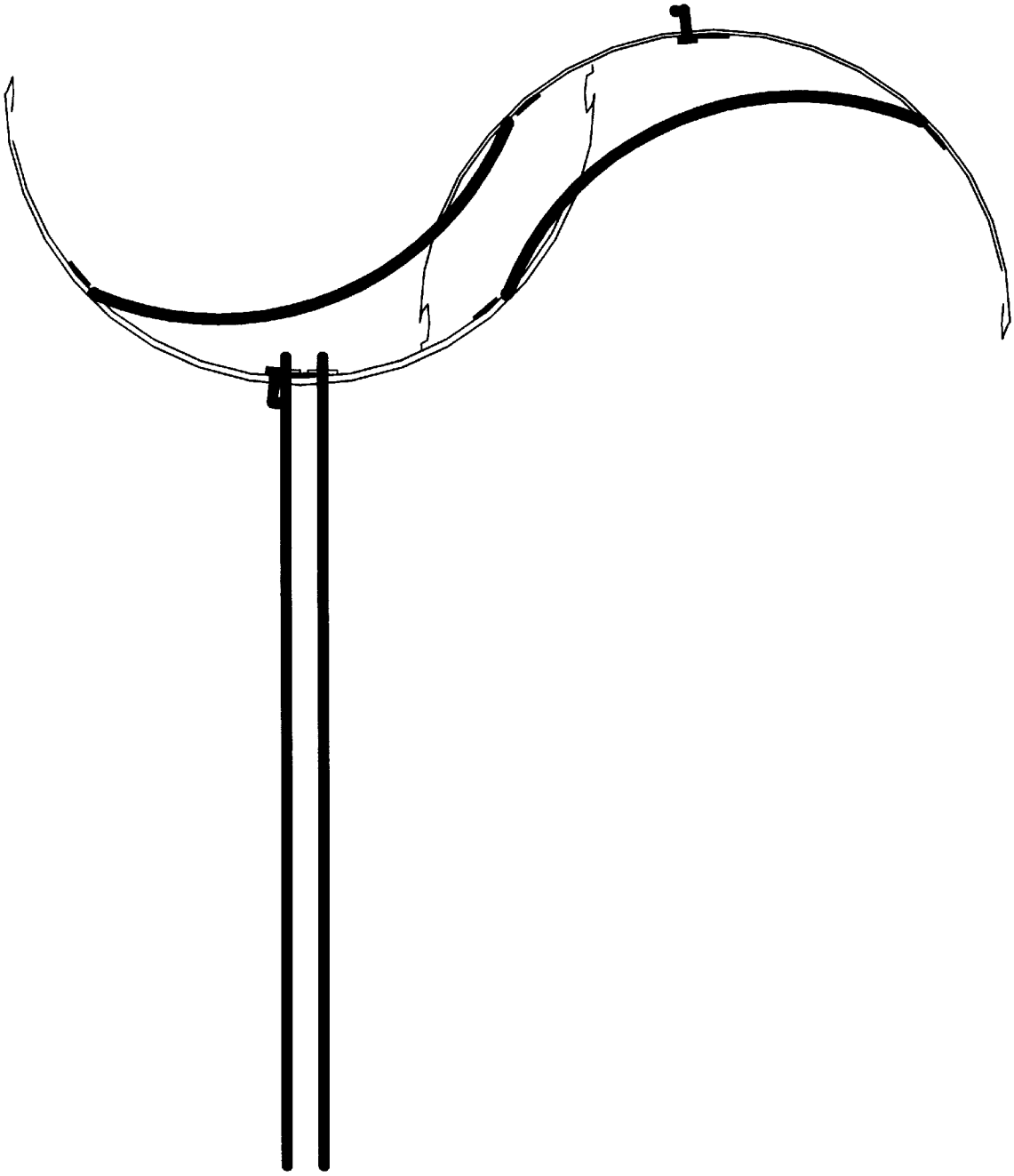
FIG. 14 shows a side view of FIG. 12.

4. Rotate the inwardly bending wall within the constraints of the guiding pivot wires 32, 34 until the concavities of the two stove sections are facing each other. Please see FIGS. 12, 13, and 14. Another way of describing steps 3 and 4 is that the two stove sections are peeled apart until the top stove section inverts as shown in FIGS. 12, 13, and 14.

5. Align the side edges and press them together along their entire length. This has the effect of joining the right side edge of the first stove section 48 with the left edge of the second stove section 60, and joining the left side edge of the first stove section 48 with the right side edge of the second stove section 60.

6. Push in on the top portions of the vent handles 90, 90 as you lift them up into the position shown in FIG. 3. Twist the vent handles one-half turn to lock them in the outward extended position. FIG. 18 gives a clearer view of how a vent handle 90 is supported when in its extended outward position.

5.2.3 Method of Disassembling the Foraged Fuel Stove

When disassembled the stove will look like FIG. 8. (Note how the hooks 110, 110 at the ends of the grill wires 106, 106 are hooked over the edges of the folded stove.) A brief overview of the stove disassembly process is as follows:

1. Release the vent handles, and let them drop to the vertical position.

2. Unlock and separate the side edges at the seams.

3. Invert the front section by curling it around the guiding pivot wires. The front section will spring into the proper position to nest inside the rear section.

4. Secure the two sections together by placing the hooked wires over the bottom edge of the stove and spreading them apart.

A more detailed set of instructions for the preferred method for disassembling the foraged fuel stove follows:

1. Twist the vent handles 90, 90 one-half turn and let them drop downward.

2. While inwardly flexing a wall of the foraged fuel stove near the middle of the seam so as to disengage the interlockable side edges of the two stove sections at the seam, separate the side edges at the seam. Separate the side edges along their entire length. Repeat this step for the other seam.

3. Separate the first and second stove sections 48, 60 from one another within the extent allowed by the guiding pivot wires 32, 34. Hold the stove as shown in FIG. 12.

4. Hold the bottom stove section with your left hand with the thumb of your left hand resting on the left side edge of the bottom stove section. Grip the top stove section with your right hand. The thumb of the right hand will be pressing down on the upper surface of the top stove section about 5 inches from the right side edge of the top stove section, and the other fingers of the right hand will be squeezing on the right side of the top stove section. Now grip and squeeze the right side edge of the top stove section, curling the right side edge of the top stove section toward the left side edge of the bottom stove section. When the right side edge of the top stove section is nearly in contact with the left side edge of the bottom stove section, move the right side edge of the top stove section across the left side edge of the bottom stove section. When this has been done, the outer surface of the inwardly bending wall begins to contact the inner surface of the other stove section.

5. While continuing to bend inwardly the inwardly bending wall, pull the center of the outer surface of the inwardly bending wall toward the inner surface of the other stove section so as to make the entire outer surface of the inwardly bending wall come into contact with the inner surface of the other stove section. In this way, the folding stove section is made to nest within the curvature of the other stove section. In performing steps 4 and 5, one has to push hard enough to overcome the spring tension of the top stove section. After performing step 5, the stove will appear similar to FIG. 11.

6. Position the hooks 110, 110 at the ends of the grill wires 106, 108 such that the grill wires make contact with the outer wall of the other stove section and the hooks 110, 110 extend over the edges of the lower ends of the nested stove sections. The disassembled stove will now appear as in FIG. 7.

7. While continuing to hold the grill wires 28, 30 against the outer wall of the other stove section, move the hooks apart from each other until each hook firmly holds together the ends of the two stove sections. The disassembled stove will now appear as in FIG. 8.

5.3 Advantages of the Invention

The petroleum-based stoves have advantages of efficiency, adjustable heat output, small size, reasonable weight (not including fuel), and they leave no burn scars in pristine areas. Their disadvantages are the requirement to buy and carry fuel, higher purchase and operating cost, poor operation in wind (optional windscreens are usually sold), poor cold weather operation, odor, fuel spills, complexity, need for periodic maintenance and associated maintenance kits, and the possibility of dangerous flare-ups if operating instructions are not followed.

There are a few foraged fuel stoves on the market, but their fireboxes are small (approximately 100 cubic inches) and they require constant tending to keep them burning.

For my stove to be better than what is already on the market, it has to meet or exceed the advantages of the existing stoves. At the same time, it has to avoid their disadvantages without adding any of its own. Here is how my stove compares. The text is summarized in the table at the end of this section. The previously described foraged fuel stove has many advantages, including:

1) Efficiency—My stove was tested in winter conditions only. All tests were conducted using foraged sticks for fuel.

The first test was conducted with an outside temperature of 5° F. and no wind. The stove brought two quarts, six ounces of water to a rapid boil in seven minutes. The same amount of water took fourteen minutes to boil on an electric kitchen stove, the burner on high, ambient temperature, 65° F.

The second test was conducted with an outside temperature of −1° F. at a wind-chill of −45° F. The stove lit easily with one match and brought one quart of water to a rapid boil in five minutes, fully exposed to the wind. The MSR™ XGK Shaker Stove which is in the $80+ price range, claims to boil one quart of water in 3.5 minutes. The ambient temperature and wind conditions of that test were not specified. The Sierra™ Zip wood burning stove can boil one quart of water in four minutes. This stove relies on a battery-powered blower to generate the heat required for this level of performance. This stove also has a firebox of less than 100 cubic inches, which means it will burn out quickly if not constantly tended. (Reference Spring 1996 Campmor® catalog, pg. 75ff.)

2) Adjustable Heat Output—All the stoves in this comparison have adjustable heat output. The gas stoves become unstable if operated at too low output. If a gas stove goes out, you must let it cool before lighting, to reduce the danger of a flare-up.

3) Size—My stove forms a firebox of more than 500 cubic inches when assembled. This large size eliminates the need to constantly tend the fire to keep it burning. When stowed, my stove requires less than 35 cubic inches. The unique geometry of the stove when stowed, allows it to be wrapped around a sleeping bag pad or similar bundle. This arrangement frees up pack space by permitting the stove to be carried in a space that is normally unused. A SVEA™ 123R stove takes more than 300 cubic inches to store, and a padded cell to carry an MSR™ Whisperlite™ stove has a volume of more than 140 cubic inches. The MSR™ stove also requires at least one fuel bottle. A 22 ounce (medium size) bottle will add more than 150 cubic inches to the space required by the MSR™ stove for a total of more than 290 cubic inches. (Reference Spring 1996 Campmor® catalog, pg. 75ff)

4) Weight—My stove weighs 25 ounces. An MSR™ Whisperlite™ stove weighs 14 ounces but it will not work unless you carry fuel. This becomes a variable, based on length of trip and how the stove is used. With one fuel bottle (volume of 22 ounces of fuel—estimate 2.5 hours of use) the total package weight is approximately 38 ounces. This does not include a heat reflector, windscreen or maintenance kit. A SVEA™ 123R stove weighs 36 ounces without fuel. (Reference Spring 1996 Campmor® catalog, pg. 75ff)

5) Burn Scars—My stove can leave a scorched circle of 4 inch radius on the earth at the bottom of the stove. A piece of aluminum foil placed underneath the stove will eliminate this mark and the stove will conform to the "leave no trace" camping ethic.

6) Buy and Carry Fuel—Not required by my stove. Since a stove that does not use foraged fuel is useless when you run out of fuel, there is a need to carry enough fuel for contingencies. The amount of margin depends on the individual. This means that you carry extra weight for insurance—not for use.

7) Purchase Price and Operating Cost—The retail cost of the material I used to build my stove was less than $4. There is no operating cost. Stoves currently on the market, suitable for backpacking, cost in the range of $30–$90, most of which are in the $40–$60 range. In addition to the cost of the stove, you may need to purchase a fuel bottle ($5–$9), a parts kit ($10–$15), heat reflector/windscreen ($8–$10), and a container to carry the loose parts ($5–$15). The operating costs would be determined by the local cost of fuel and the replenishment of consumable items from the parts kit. (Reference Spring 1996 Campmor® catalog, pg. 75ff.)

8) Operation in Windy Conditions—The firebox of my stove is the windscreen. The stove is lit from the bottom and the match is shielded from the wind. In windy conditions, the stove operation can be optimized by adjusting the air vents. This also reduces the fire hazard that can be caused by blowing sparks.

9) Cold Weather Operation—My stove was field tested under winter conditions (see paragraph 1, Efficiency). Liquid stoves that require a pressurized fuel source are subject to a decrease in pressure as the temperature drops, frozen impurities in the fuel causing clogs, and "O" rings becoming brittle and breaking. Butane/propane stoves provide enhanced operation over liquid fuel stoves in cold weather; however their fuel canisters typically weigh 20 ounces and have to be disposed of after use. (Reference Spring 1996 Campmor® catalog, pg. 75ff.)

10) Complexity—My stove is simple in design and operation. It takes less than 20 seconds to transform the stove from its stowed condition to fully assembled (same to reverse the process). All the parts are attached to the stove, so no parts get lost. The grill wires are adjustable and can accommodate containers from the size of a cup to a Dutch oven. When stowed, the 2 halves lock together using the grill wires as the locking mechanism. The burn rate is controlled by opening and closing the air vents. The stove is rugged and its operation is not affected by dents and age. Should the stove become deformed, it can be reshaped by hand.

11) Periodic Maintenance Requirements—My stove requires no maintenance. The MSR™ Whisperlite™ stove manual has five pages dedicated to troubleshooting and maintenance, covering pump plunger, fuel tube "O" ring, control valve, check valve, burner, and jet. The maintenance kits for stoves currently on the market are in the price range of $10–$15. (Reference Spring 1996 Campmor® catalog, pg. 75ff 12) Danger from Flare-ups—My stove does not flare-up. Liquid fuel stoves have the potential to flare if they are over-primed, leak or an attempt is made to light the stove when it is hot.

STOVE COMPARISON TABLE

| | | MY STOVE (FORAGE) | MSR ™ (GAS) | SVEA ™ (GAS) | Sierra ™ (WOOD) |
|---|---|---|---|---|---|
| 1) | Efficiency To boil one quart of water | <5 min (sub-zero test) | 3.5 min (ambient temperature unknown) | 7 min (ambient temperature unknown) | 4 min (ambient temperature unknown) |
| 2) | Adjustable Heat Output | yes | yes | yes | yes |
| 3) | Size Packed (cu in) | <35 | >290 (with 1 fuel bottle) | >300 | >300 |
| 4) | Weight (oz) | 25 | 38 (with 1 fuel bottle) | 36 (batteries extra) | 16 |
| 5) | Earth Burn Scars | no | no | no | no |
| 6) | Buy and Carry Fuel | no | yes | yes | no (needs batteries) |
| 7) | Purchase Price (estimate) | <$55 | $80 + $8 (fuel bottle) | $65 | $50 |
| 7a) | Operating Cost | no | yes | yes | yes |

-continued

STOVE COMPARISON TABLE

| | | MY STOVE (FORAGE) | MSR ™ (GAS) | SVEA ™ (GAS) | Sierra ™ (WOOD) |
|---|---|---|---|---|---|
| 8) | Needs Windscreen | no | yes | yes | yes |
| 9) | Cold Causes Decrease in Operating Efficiency | no | yes | yes | yes (battery and blower affected) |
| 10) | Complex | no | yes | yes | yes |
| 11) | Maintenance | no | yes | yes | no |
| 12) | Flare-ups | no | yes | yes | no |

5.4 LIST OF REFERENCE NUMBERS

| | |
|---|---|
| 20 | foraged fuel stove |
| 22 | first hollow semi-cylinder |
| 24 | second hollow semi-cylinder |
| 26 | means for adjusting the air intake |
| 28 | first grill wire |
| 30 | second grill wire |
| 32 | first guiding pivot wire |
| 34 | second guiding pivot wire |
| 35 | spoon |
| 36 | V-shaped bend |
| 38 | matching clasp-like structure |
| 40 | side edge of first stove section which terminates in a V-shaped bend |
| 42 | side edge of first stove section which terminates in a matching clasp-like structure |
| 44 | side edge of second stove section which terminates in a V-shaped bend |
| 46 | side edge of second stove section which terminates in a matching clasp-like structure |
| 48 | first stove section |
| 50 | wall of first stove section |
| 52 | edge of the upper end of wall of the first stove section |
| 54 | edge of the lower end of wall of the first stove section |
| 56 | upper end of wall of the first stove section |
| 58 | lower end of wall of the first stove section |
| 60 | second stove section |
| 62 | wall of second stove section |
| 64 | edge of the upper end of wall of the second stove section |
| 66 | edge of the lower end of wall of the second stove section |
| 68 | upper end of wall of the second stove section |
| 70 | lower end of wall of the second stove section |
| 72 | stove cylinder |
| 74 | wall of stove cylinder |
| 76 | upper end of wall of stove cylinder |
| 78 | lower end of wall of stove cylinder |
| 80 | upper circular opening |
| 82 | lower circular opening |
| 84 | series of spaced openings in wall of stove |
| 86 | sliding sheet |
| 88 | opening in sliding sheet |
| 90 | vent handle |
| 92 | lower leg of L shaped vent handle |
| 94 | inner wall of sliding sheet |
| 96 | upper leg of L shaped vent handle |
| 98 | tip of vent handle |
| 100 | outer wall of stove |
| 102 | rolled up sleeping pad |
| 104 | first attached end of grill wire |
| 106 | second unattached end of grill wire |
| 108 | means for attaching to end of wall |
| 110 | hook |

-continued 5.4 LIST OF REFERENCE NUMBERS

| | |
|---|---|
| 112 | first end of first guiding pivot wire |
| 114 | second end of first guiding pivot wire |
| 116 | first end of second guiding pivot wire |
| 118 | second end of second guiding pivot wire |
| 120 | first leg of guiding pivot wire |
| 122 | second leg of guiding pivot wire |
| 124 | curved crossbar of guiding pivot wire |
| 126 | channel |
| 128 | rivet |

It will be understood that each of the elements described above, or two or more together may also find a useful application in other types of devices and methods differing from those types described above.

5.5 Alternatives and the Closing

Thus the reader will see that my foraged fuel stove supplies a long felt need for a rugged, simple, economical, easy to use, occupying minimal space when packed, backpacking stove that will boil one quart of water at an outdoor temperature of 0° F. in less than five minutes using foraged fuel. If one should aver that my foraged fuel stove is obvious, then one is hard put to explain why people going camping persist in carrying a stove and the fuel it requires. As it is, stoves that require refined petroleum products currently dominate the market.

Although the present invention has been described in considerable detail with reference to certain preferred versions thereof, other versions are possible which will be apparent to those who are skilled in the art. For example, the interlockable side edges that form the releasable seams can be made from opposing U-shaped bends, a series of interlacing fingers, tabs, and the like. My stove can also be used as a grill by placing a round cooling rack (such as a #4364 cake rack from Adam Industries, Inc., Chicago, Ill.) on the top. No cleanup of the stove is necessary because the grease drops into the fire and not on the stove. When you finish using it as a stove, lift it up, and you already have your evening campfire started. The stove can be converted into a charcoal starter by placing the charcoal on top of crumpled newspaper. While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Therefore, the spirit and scope of the appended claims should not be limited to the description of the preferred versions contained herein, but by the appended claims and their legal equivalents.

What is claimed is:

1. A foraged fuel stove having an assembled state having a predetermined volume and a disassembled state having a predetermined volume, said foraged fuel stove comprising:

(a) a first hollow semi-cylinder comprising a first section of sheet metal having a convex outer surface and a concave inner surface, and having a left side edge and a right side edge, said first section of semi-cylindrical sheet metal having a wall of predetermined height, said wall having an upper end having an upper edge defining a semicircle and a lower end having a lower edge defining a semicircle;

(b) a second hollow semi-cylinder comprising a second section of sheet metal having a convex outer surface and a concave inner surface, and having a left side edge and a right side edge, said second section of semi-cylindrical sheet metal having a wall having a height substantially equal to the height of said first section of semi-cylindrical sheet metal, said wall having an upper end having an upper edge defining a semicircle and a lower end having a lower edge defining a semicircle;

wherein, when said first hollow semi-cylinder is positioned such that its concave inner surface is facing the concave.

2. The foraged fuel stove of claim 1, wherein the means for adjusting the air intake comprises:

(a) at least one opening passing through the wall of at least one of the hollow semi-cylinders near the lower end of the wall;

(b) at least one sliding sheet larger than said at least one opening slidably attached to said wall of said hollow semi-cylinder in the vicinity of said at least one opening, said sliding sheet having an open position in which said at least one opening is revealed and a closed position in which said at least one opening is covered, whereby the amount of air allowed to the interior of said cylinder of said assembled stove can be controlled, and (c) a vent handle affixed to the at least one sliding sheet whereby the sliding sheet can be slidably moved.

3. The foraged fuel stove of claim 2, wherein the means for attaching to the end of a wall comprises hooks at the second ends of said wires and the length of each of the at least two grill wires is sufficiently greater than the height of the hollow cylinder, whereby the hooks at the second ends of the at least two grill wires can be used to secure the disassembled foraged fuel stove by being hooked over the edges of the lower ends of the first and second hollow semi-cylinders.

4. The foraged fuel stove of claim 3, wherein the curvature of the semi-cylinder of said second section of semi-cylindrical sheet metal is substantially equal to the curvature of the semi-cylinder of said first section of semi-cylindrical sheet metal, whereby when one of said sections of semi-cylindrical sheet metal is nested within the other of said sections of semi-cylindrical sheet metal for storage purposes, then the hooks at the unattached ends of said grill wires may be used to securely fasten together the two sections of semi-cylindrical sheet metal, whereby said disassembled foraged fuel stove occupies minimal space when the two sections of semi-cylindrical sheet metal are nested.

5. The foraged fuel stove of claim 4, further comprising:

(a) a first guiding pivot wire having a first end and a second end, said first end of said first guiding pivot wire being movably affixed to the first hollow semi-cylinder near its upper edge, and said second end of said first guiding pivot wire being movably affixed to the second hollow semi-cylinder near its upper edge, and (b) a second guiding pivot wire having a first end and a second end, said first end of said second guiding pivot wire being movably affixed to the first hollow semi-cylinder near its upper edge, and said second end of said second guiding pivot wire being movably affixed to the second hollow semi-cylinder near its upper edge, said first and second guiding pivot wires being of sufficient length to allow the foraged fuel stove to be easily assembled and disassembled.

6. The foraged fuel stove of claim 5, wherein each guiding pivot wire has two legs and a cross piece connecting the two legs, and the walls of each of the semi-cylinders have channels formed therein for the reception of the legs of the guiding pivot wires, whereby said semi-cylinders and said guiding pivot wires are joinedly linked together to form a stove which is essentially of one piece construction.

7. The foraged fuel stove of claim 3, wherein in said foraged fuel stove's disassembled stove state, said second section of semi-cylindrical sheet metal is fitted within the semi-cylindrical concavity of said first section of semi-cylindrical sheet metal, said second section of semi-cylindrical sheet metal being secured to said opened first section of semi-cylindrical sheet metal by the hooks at the unattached ends of said grill wires, the hooks of said wires holding the two opened sections of semi-cylindrical sheet metal together.

8. The foraged fuel stove of claim 2, wherein the curvature of the semi-cylinder of said second section of semi-cylindrical sheet metal is substantially equal to the curvature of the semi-cylinder of said first section of semi-cylindrical sheet metal, whereby when one of said sections of semi-cylindrical sheet metal is nested within the other of said sections of semi-cylindrical sheet metal for storage purposes, then the means for attaching to the end of a wall may be used to securely fasten the two sections of semi-cylindrical sheet metal together, whereby said foraged fuel stove occupies minimal space when the two sections of semi-cylindrical sheet metal are nested.

9. The foraged fuel stove of claim 2, wherein in said foraged fuel stove's disassembled stove state, said opened second section of semi-cylindrical sheet metal is fitted within the semi-cylindrical concavity of said opened first section of semi-cylindrical sheet metal, said opened second section of semi-cylindrical sheet metal being secured to said opened first section of semi-cylindrical sheet metal by the hooks at the unattached ends of said grill wires, the hooks of said wires holding the two opened sections of semi-cylindrical sheet metal together.

10. The foraged fuel stove of claim 1, wherein the means for attaching to the end of a wall comprises hooks at the second ends of said wires and the length of each of the at least two grill wires is sufficiently greater than the height of the hollow cylinder, whereby the hooks at the second ends of the at least two grill wires can be used to secure the disassembled foraged fuel stove by being hooked over the edges of the lower ends of the first and second hollow semi-cylinders.

11. The foraged fuel stove of claim 10, wherein the curvature of the semi-cylinder of said second section of semi-cylindrical sheet metal is substantially equal to the curvature of the semi-cylinder of said first section of semi-cylindrical sheet metal, whereby when one of said sections of semi-cylindrical sheet metal is nested within the other of said sections of semi-cylindrical sheet metal for storage purposes, then the hooks at the unattached ends of said grill wires may be used to securely fasten together the two opened sections of semi-cylindrical sheet metal, whereby said disassembled foraged fuel stove occupies minimal space when the two sections of semi-cylindrical sheet metal are nested.

12. The foraged fuel stove of claim 10, wherein in said foraged fuel stove's disassembled stove state, said second section of semi-cylindrical sheet metal is fitted within the semi-cylindrical concavity of said first section of semi-cylindrical sheet metal, said second section of semi-cylindrical sheet metal being secured to said first section of semi-cylindrical sheet metal by the hooks at the unattached ends of said grill wires, the hooks of said wires holding the two sections of semi-cylindrical sheet metal together.

13. The foraged fuel stove of claim 1, further comprising:

(a) a first guiding pivot wire having a first end and a second end, said first end of said first guiding pivot wire being movably affixed to the first hollow semi-cylinder near its upper edge, and said second end of said first guiding pivot wire being movably affixed to the second hollow semi-cylinder near its upper edge, and (b) a second guiding pivot wire having a first end and a second end, said first end of said second guiding pivot wire being movably affixed to the first hollow semi-cylinder near its upper edge, and said second end of said second guiding pivot wire being movably affixed to the second hollow semi-cylinder near its upper edge, said first and second guiding pivot wires being of sufficient length to allow the foraged fuel stove to be easily assembled and disassembled.

14. The foraged fuel stove of claim 1, wherein the curvature of the semi-cylinder of said second section of semi-cylindrical sheet metal is substantially equal to the curvature of the semi-cylinder of said first section of semi-cylindrical sheet metal, whereby when one of said sections of semi-cylindrical sheet metal is nested within the other of said sections of semi-cylindrical sheet metal for storage purposes, then the means for attaching to the end of a wall can be used to securely fasten the two sections of semi-cylindrical sheet metal together, whereby said disassembled foraged fuel stove occupies minimal space when the two sections of semi-cylindrical sheet metal are nested.

15. The foraged fuel stove of claim 1, wherein in said foraged fuel stove's disassembled stove state, said second section of semi-cylindrical sheet metal is fitted within the semi-cylindrical concavity of said first section of semi-cylindrical sheet metal, said second section of semi-cylindrical sheet metal being secured to said first section of semi-cylindrical sheet metal by the hooks at the unattached ends of said grill wires, the hooks of said wires holding the two sections of semi-cylindrical sheet metal together.

16. The foraged fuel stove of claim 1, wherein the means for adjusting the air intake comprises:

(a) a series of spaced openings passing through the wall of at least one of the hollow semi-cylinders near the lower end of the wall;

(b) at least one sliding sheet of sufficient size to cover the series of spaced openings slidably attached to said wall of said hollow semi-cylinder in the vicinity of said at least one opening, said sliding sheet having an open position in which said series of spaced openings is uncovered and a closed position in which said series of spaced openings is covered, whereby the amount of air allowed to the interior of said cylinder of said assembled stove can be controlled, and (c) a vent handle affixed to the at least one sliding sheet whereby the sliding sheet can be slidably moved.

17. The foraged fuel stove of claim 16, wherein the distance between successive spaced openings is greater than or equal to the width of a spaced opening.

18. The foraged fuel stove of claim 1, wherein the ratio of the volume of the assembled state of the stove to the volume of the disassembled state of the stove is greater than 12 to 1.

19. A method of disassembling the foraged fuel stove of claim 5 comprising;

(a) unlocking and separating the right side edge of said first hollow semi-cylinder from the left side edge of said second hollow semi-cylinder and unlocking and separating said left side edge of said first hollow semi-cylinder from said right side edge of said second hollow semi-cylinder;

(b) separating the first and second hollow semi-cylinders from one another within the extent allowed by the guiding pivot wires;

(c) pressing inwardly at the outer wall of one of the hollow semi-cylinders near a right or left side edge thereof until that side edge comes in contact with the inner surface of the other hollow semi-cylinder;

(d) continuing to bend inwardly said outer wall until the outer surface of said outer wall comes in contact with the inner surface of the other hollow semi-cylinder;

(e) while continuing to bend inwardly said outer wall, pulling the center of the outer surface of said outer wall toward the inner surface of the other hollow semi-cylinder so as to make the entire outer surface of said outer wall come into contact with the inner surface of said other hollow semi-cylinder, whereby said one of the hollow semi-cylinders is made to nest within the curvature of said other hollow semi-cylinder;

(f) positioning the hooks at the ends of the grill wires such that the grill wires make contact with the outer wall of said other hollow semi-cylinder and the hooks extend over the edges of the lower ends of the nested hollow semi-cylinders; and (g) while continuing to contact the grill wires with the outer wall of said other hollow semi-cylinder, moving the hooks apart from each other until each hook firmly holds together the ends of the two nested hollow semi-cylinders.

20. A method of assembling the disassembled foraged fuel stove of claim 19 comprising:

(a) moving the hooks holding together the lower ends of the nested hollow cylinders toward each other and disengaging the hooks from the edges of the lower ends of the nested hollow semi-cylinders;

(b) bending inwardly a wall of the inner nested hollow semi-cylinder and pulling the center of the outer surface of the inwardly bending wall away from the inner surface of the other hollow semi-cylinder until only a side edge of the inwardly bending wall is in contact with the inner surface of the other hollow semi-cylinder;

(c) rotating the inwardly bending wall within the constraints of the guiding pivot wires until the concavities of the two hollow semi-cylinders are facing each other; and (d) joining the right side edge of said first hollow semi-cylinder with the left side edge of said second hollow semi-cylinder, and joining said left side edge of said first hollow semi-cylinder with said right side edge of said second hollow semi-cylinder.

* * * * *

UNITED STATES PATENT AND TRADEMARK OFFICE

CERTIFICATE OF CORRECTION

PATENT NO. : 5,915,371
DATED : June 29, 1999
INVENTOR(S) : Kent M. Hering

It is certified that error appears in the above-indentified patent and that said Letters Patent is hereby corrected as shown below:

In Claim 1, lines 21-23 (under Col. 15), replace "wherein, when said first hollow semi-cylinder is positioned such that its concave inner surface is facing the concave." with --wherein, when said first hollow semi-cylinder is positioned such that its concave inner surface is facing the concave inner surface of the second hollow semi-cylinder, said right side edge of said first section of sheet metal is interlockable with said left side edge of said second section of sheet metal, and said left side edge of said first section of sheet metal is interlockable with said right side edge of said second section of sheet metal, whereby said second section of semi-cylindrical sheet metal is removably joinable to said first section of semi-cylindrical sheet metal, whereby there can be formed a hollow cylinder having seams where the side edges of the first and second sections of sheet metal join, and having an outer wall and an inner wall defining an interior, said wall having an upper end having an edge defining an upper circular opening and a lower end having an edge defining a lower circular opening, said openings having a predetermined diameter;

means for adjusting the air intake incorporated into at least one of said sections;

at least two grill wires, wherein:

(i) each of said grill wires has a first attached end and a second end having means for attaching to the end of a wall, the first attached ends of said grill wires being movably attached to the upper end of the wall of the hollow cylinder;

(ii) the length of each of the at least two grill wires is greater than the diameter of the hollow cylinder, whereby when the at least two grill wires are positioned across the upper circular opening of said assembled stove, a support is provided for cooking utensils to be placed thereon and to be hung from the second ends thereof, and (iii) the length of each of the at least two grill wires is greater than the height of the hollow cylinder, whereby the two grill wires can be attached to the lower end of a wall of said hollow cylinder.--.

UNITED STATES PATENT AND TRADEMARK OFFICE

CERTIFICATE OF CORRECTION

PATENT NO. : 5,915,371
DATED : June 29, 1999
INVENTOR(S) : Kent M. Hering

It is certified that error appears in the above-indentified patent and that said Letters Patent is hereby corrected as shown below:

Col. 2, Line 62, replace "square-shaped" with --square-U-shaped--.

Col. 7, Line 58, delete "opened".

Col. 8, Line 51, replace "seams" with --edges--.

Col. 9, Line 16, replace "left edge" with --left side edge--.

Col. 9, Line 64, replace "right side of" with --right side edge of--.

In Claim 7, in Lines 6 and 9, delete "opened".

In Claim 9, in Lines 2, 4, 5, 7, and 9, delete "opened".

In Claim 11, in Line 10, delete "opened".

Signed and Sealed this

Seventh Day of December, 1999

*Attest:*

*Attesting Officer*

Q. TODD DICKINSON

*Acting Commissioner of Patents and Trademarks*